US010689774B2

(12) United States Patent
He et al.

(10) Patent No.: US 10,689,774 B2
(45) Date of Patent: Jun. 23, 2020

(54) CONTROL OF CURRENT DENSITY IN AN ELECTROPLATING APPARATUS

(71) Applicant: Lam Research Corporation, Fremont, CA (US)

(72) Inventors: Zhian He, Lake Oswego, OR (US); Ashwin Ramesh, Beaverton, OR (US); Shantinath Ghongadi, Tigard, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 16/244,621

(22) Filed: Jan. 10, 2019

(65) Prior Publication Data

US 2019/0145018 A1 May 16, 2019

Related U.S. Application Data

(60) Continuation of application No. 15/984,119, filed on May 18, 2018, now Pat. No. 10,214,828, which is a division of application No. 14/664,652, filed on Mar. 20, 2015, now Pat. No. 10,011,917, which is a continuation-in-part of application No. 13/907,265, (Continued)

(51) Int. Cl.

| | |
|---|---|
| ***C25D 17/00*** | (2006.01) |
| ***C25D 5/18*** | (2006.01) |
| ***C25D 17/12*** | (2006.01) |
| ***C25D 21/12*** | (2006.01) |

(52) U.S. Cl.

CPC ..... *C25D 17/001* (2013.01); *C25D 5/18* (2013.01); *C25D 17/12* (2013.01); *C25D 21/12* (2013.01)

(58) Field of Classification Search

CPC ..... C25D 17/001; C25D 17/12; C25D 21/12

See application file for complete search history.

(56) References Cited

U.S. PATENT DOCUMENTS

| | | | |
|---|---|---|---|
| 1,225,395 | A | 5/1917 | Duram |
| 3,849,002 | A | 11/1974 | Hach |

(Continued)

FOREIGN PATENT DOCUMENTS

| | | | |
|---|---|---|---|
| CN | 1985026 | A | 6/2007 |
| CN | 101736376 | A | 6/2010 |

(Continued)

OTHER PUBLICATIONS

U.S. Office Action dated Oct. 9, 2015 issued in U.S. Appl. No. 13/987,311.

(Continued)

*Primary Examiner* — Nicholas A Smith

(74) *Attorney, Agent, or Firm* — Weaver Austin Villeneuve & Sampson LLP

(57) ABSTRACT

Various embodiments herein relate to methods and apparatus for electroplating metal onto substrates. In various cases, a reference electrode may be modified to promote improved electroplating results. The modifications may relate to one or more of the reference electrode's shape, position, relative conductivity compared to the electrolyte, or other design feature. In some particular examples the reference electrode may be dynamically changeable, for example having a changeable shape and/or position. In a particular example the reference electrode may be made of multiple segments. The techniques described herein may be combined as desired for individual applications.

13 Claims, 13 Drawing Sheets

Related U.S. Application Data filed on May 31, 2013, now Pat. No. 9,309,604, which is a division of application No. 12/481,503, filed on Jun. 9, 2009, now Pat. No. 8,475,636, which is a continuation-in-part of application No. 12/291,356, filed on Nov. 7, 2008, now Pat. No. 8,308,931.

(56) References Cited

U.S. PATENT DOCUMENTS

| | | | |
|---|---|---|---|
| 4,092,226 | A | 5/1978 | Laing et al. |
| 4,101,919 | A | 7/1978 | Ammann |
| 4,229,191 | A | 10/1980 | Moore |
| 4,272,335 | A | 6/1981 | Combs |
| 4,297,217 | A | 10/1981 | Hines et al. |
| 4,459,194 | A | 7/1984 | Fletcher et al. |
| 4,461,680 | A | 7/1984 | Lashmore |
| 4,563,399 | A | 1/1986 | Wright, Jr. |
| 4,975,159 | A | 12/1990 | Dahms |
| 5,000,827 | A | 3/1991 | Schuster et al. |
| 5,221,449 | A | 6/1993 | Colgan et al. |
| 5,252,196 | A | 10/1993 | Sonnenberg et al. |
| 5,281,485 | A | 1/1994 | Colgan et al. |
| 5,368,711 | A | 11/1994 | Poris |
| 5,482,605 | A | 1/1996 | Taylor |
| 5,482,611 | A | 1/1996 | Helmer et al. |
| 5,618,634 | A | 4/1997 | Hosoda et al. |
| 5,831,727 | A | 11/1998 | Stream |
| 5,935,762 | A | 8/1999 | Dai et al. |
| 5,936,707 | A | 8/1999 | Nguyen et al. |
| 5,939,788 | A | 8/1999 | McTeer |
| 5,969,422 | A | 10/1999 | Ting et al. |
| 5,972,192 | A | 10/1999 | Dubin et al. |
| 5,985,762 | A | 11/1999 | Geffken et al. |
| 6,004,470 | A | 12/1999 | Abril |
| 6,074,544 | A | 6/2000 | Reid et al. |
| 6,074,594 | A | 6/2000 | Byer et al. |
| 6,099,702 | A | 8/2000 | Reid et al. |
| 6,099,711 | A | 8/2000 | Dahms et al. |
| 6,099,712 | A | 8/2000 | Ritzdorf et al. |
| 6,110,346 | A | 8/2000 | Reid et al. |
| 6,113,771 | A | 9/2000 | Landan et al. |
| 6,117,784 | A | 9/2000 | Uzoh |
| 6,124,203 | A | 9/2000 | Joo et al. |
| 6,126,798 | A | 10/2000 | Reid et al. |
| 6,132,584 | A | 10/2000 | Hubel |
| 6,139,712 | A | 10/2000 | Patton et al. |
| 6,140,241 | A | 10/2000 | Shue et al. |
| 6,156,167 | A | 12/2000 | Patton et al. |
| 6,159,354 | A | 12/2000 | Contolini et al. |
| 6,162,344 | A | 12/2000 | Reid et al. |
| 6,168,693 | B1 | 1/2001 | Uzoh et al. |
| 6,179,973 | B1 | 1/2001 | Lai et al. |
| 6,179,983 | B1 | 1/2001 | Reid et al. |
| 6,193,854 | B1 | 2/2001 | Lai et al. |
| 6,197,179 | B1 | 3/2001 | Arlt et al. |
| 6,197,181 | B1 | 3/2001 | Chen |
| 6,203,684 | B1 | 3/2001 | Taylor et al. |
| 6,217,716 | B1 | 4/2001 | Fai Lai |
| 6,221,757 | B1 | 4/2001 | Schmidbauer et al. |
| 6,251,242 | B1 | 6/2001 | Fu et al. |
| 6,261,433 | B1 | 7/2001 | Landau |
| 6,274,008 | B1 | 8/2001 | Gopalraja et al. |
| 6,277,249 | B1 | 8/2001 | Gopalraja et al. |
| 6,395,101 | B1 | 5/2002 | Scranton et al. |
| 6,413,388 | B1 | 7/2002 | Uzoh et al. |
| 6,503,376 | B2 | 1/2003 | Toyoda et al. |
| 6,540,899 | B2 | 4/2003 | Keigler |
| 6,551,483 | B1 | 4/2003 | Mayer et al. |
| 6,551,487 | B1 | 4/2003 | Reid et al. |
| 6,562,204 | B1 | 5/2003 | Mayer et al. |
| 6,582,578 | B1 | 6/2003 | Dordi et al. |
| 6,627,051 | B2 | 9/2003 | Berner et al. |
| 6,796,877 | B1 | 9/2004 | Bingham et al. |
| 6,800,187 | B1 | 10/2004 | Reid et al. |
| 6,911,136 | B2 | 6/2005 | Zheng et al. |
| 6,913,680 | B1 | 7/2005 | Zheng et al. |
| 6,946,065 | B1 | 9/2005 | Mayer et al. |
| 6,964,792 | B1 | 11/2005 | Mayer et al. |
| 7,097,410 | B1 | 8/2006 | Reid et al. |
| 7,686,927 | B1 | 3/2010 | Reid et al. |
| 7,727,863 | B1 | 6/2010 | Buckalew et al. |
| 7,879,218 | B1 | 2/2011 | Webb et al. |
| 8,048,280 | B2 | 11/2011 | Mayer et al. |
| 8,308,931 | B2 | 11/2012 | Reid et al. |
| 9,028,666 | B2 | 5/2015 | Ranjan et al. |
| 9,385,035 | B2 | 7/2016 | Spurlin et al. |
| 9,587,322 | B2 | 3/2017 | Ranjan et al. |
| 10,011,917 | B2 | 7/2018 | He et al. |
| 10,214,828 | B2 | 2/2019 | He et al. |
| 10,214,829 | B2 | 2/2019 | He et al. |
| 2002/0029973 | A1 | 3/2002 | Maydan |
| 2002/0084183 | A1 | 7/2002 | Hanson et al. |
| 2002/0084189 | A1 | 7/2002 | Wang et al. |
| 2004/0016637 | A1 | 1/2004 | Yang et al. |
| 2004/0206628 | A1 | 10/2004 | Lubomirsky et al. |
| 2005/0029106 | A1 | 2/2005 | Baniahmad et al. |
| 2005/0183959 | A1 | 8/2005 | Wilson et al. |
| 2005/0208774 | A1 | 9/2005 | Fukunaga et al. |
| 2006/0011483 | A1 | 1/2006 | Mayer et al. |
| 2006/0201814 | A1 | 9/2006 | Hafezi et al. |
| 2007/0080067 | A1 | 4/2007 | Gu et al. |
| 2007/0105247 | A1 | 5/2007 | Mauersberger et al. |
| 2008/0057211 | A1 | 3/2008 | Chen et al. |
| 2008/0149489 | A1 | 6/2008 | Varadarajan et al. |
| 2010/0032310 | A1 | 2/2010 | Reid et al. |
| 2011/0284386 | A1 | 11/2011 | Willey et al. |
| 2012/0090987 | A1 | 4/2012 | Gorer et al. |
| 2012/0258408 | A1 | 10/2012 | Mayer et al. |
| 2012/0292192 | A1 | 11/2012 | Ranjan et al. |
| 2014/0224661 | A1 | 8/2014 | Spurlin et al. |
| 2015/0008132 | A1 | 1/2015 | Stahl et al. |
| 2015/0218727 | A1 | 8/2015 | Ranjan et al. |
| 2017/0137958 | A1 | 5/2017 | Ranjan et al. |
| 2017/0362734 | A9 | 12/2017 | He et al. |
| 2018/0266005 | A1 | 9/2018 | He et al. |
| 2018/0266006 | A1 | 9/2018 | He et al. |

FOREIGN PATENT DOCUMENTS

| | | | |
|---|---|---|---|
| CN | 102732924 | A | 10/2012 |
| JP | 2001-232278 | | 8/2001 |
| JP | 2003-129297 | A | 5/2003 |
| JP | 2005-264245 | | 9/2005 |
| KR | 1020100093763 | A | 8/2010 |
| KR | 1020120023639 | A | 3/2012 |
| WO | WO 99/41434 | | 8/1999 |

OTHER PUBLICATIONS

U.S. Notice of Allowance dated Mar. 10, 2016 issued in U.S. Appl. No. 13/987,311.

U.S. Office Action dated May 5, 2017 issued in U.S. Appl. No. 14/664,652.

U.S. Final Office Action dated Dec. 6, 2017 issued in U.S. Appl. No. 14/664,652.

U.S. Notice of Allowance dated Feb. 20, 2018 issued in U.S. Appl. No. 14/664,652.

U.S. Notice of Allowance dated Oct. 26, 2018 issued in U.S. Appl. No. 15/984,119.

U.S. Notice of Allowance dated Oct. 11, 2018 issued in U.S. Appl. No. 15/984,162.

U.S. Office Action dated Oct. 3, 2002 issued in U.S. Appl. No. 09/872,341.

U.S. Notice of Allowance dated Feb. 5, 2003 issued in U.S. Appl. No. 09/872,341.

U.S. Office Action dated Jun. 27, 2005 issued in U.S. Appl. No. 10/379,858.

U.S. Final Office Action dated Dec. 14, 2005 issued in U.S. Appl. No. 10/379,858.

U.S. Notice of Allowance dated Jun. 8, 2006 issued in U.S. Appl. No. 10/379,858.

(56) References Cited

OTHER PUBLICATIONS

U.S. Office Action dated Jun. 26, 2009 issued in U.S. Appl. No. 11/510,048.
U.S. Notice of Allowance dated Nov. 19, 2009 issued in U.S. Appl. No. 11/510,048.
U.S. Office Action dated May 28, 2002 issued in U.S. Appl. No. 09/716,016.
U.S. Office Action dated Jan. 6, 2003 issued in U.S. Appl. No. 09/716,016.
U.S. Final Office Action dated Feb. 4, 2004 issued in U.S. Appl. No. 09/716,016.
U.S. Notice of Allowance dated Apr. 21, 2004 issued in U.S. Appl. No. 09/716,016.
U.S. Office Action dated Jun. 10, 2009 issued in U.S. Appl. No. 11/228,712.
U.S. Final Office Action dated Jan. 7, 2010 issued in U.S. Appl. No. 11/228,712.
U.S. Office Action dated Oct. 12, 2010 issued in U.S. Appl. No. 11/228,712.
U.S. Final Office Action dated Apr. 29, 2011 issued in U.S. Appl. No. 11/228,712.
U.S. Notice of Allowance dated Aug. 16, 2011 issued in U.S. Appl. No. 11/228,712.
U.S. Office Action dated Jul. 19, 2013 issued in U.S. Appl. No. 13/286,103.
U.S. Final Office Action dated Nov. 8, 2013 issued in U.S. Appl. No. 13/286,103.
U.S. Notice of Allowance dated Jan. 20, 2015 issued in U.S. Appl. No. 13/460,423.
U.S. Office Action dated Dec. 4, 2015 issued in U.S. Appl. No. 14/686,479.
U.S. Final Office Action dated Aug. 19, 2016 issued in U.S. Appl. No. 14/686,479.
U.S. Notice of Allowance dated Oct. 27, 2016 issued in U.S. Appl. No. 14/686,479.
Chinese First Office Action dated Jul. 28, 2017 issued in Application No. CN 201610156899.5.
Chinese Second Office Action dated Nov. 5, 2018 issued in Application No. CN 201610156899.5.
Taiwan First Office Action dated Oct. 17, 2017 issued in Application No. TW 103100545.
Chinese First Office Action dated Oct. 9, 2015 issued in Application No. CN 201210153279.8.
Chinese Second Office Action dated May 26, 2016 issued in Application No. CN 201210153279.8.
Taiwan Office Action dated Mar. 1, 2016 issued in Application No. TW101117463.
Korean First Office Action dated Oct. 18, 2018 issued in Application No. KR 10-2012-0050124.
Chang, C.Y. and Sze, S.M., Editors (1996) "ULSI Technology," Eds, *McGraw-Hill*, 1996, pp. 444-445.
Contolini, Robert J., Tarte, Lisa, Graff, Robert T., Evans, Lee B., Cox, J. Neal, Puich, Marc R., Gee, Justin E., Mu, Xiao-Chun, Chiang, Chien (Jun. 27-29, 1995) "Copper Electroplating Process for Sub-Half-Micron ULSI Structures," *VMIC Conf.* pp. 322-325.
Dubin, Valery M., Shacham-Diamand, Yosi, Zhao, Bin, Vasudev, P.K., Ting, Chiu H. (Jun. 26 & 27, 1995) "Selective and Blanket Electroless Cu Plating Initiated by Contact Displacement for Deep Submicron Via Contact Filling," *VMIC Conf.* pp. 314-321.
Lowenheim, Fredereick A., (1978) "Electroplating," *McGraw-Hill Book Company*, pp. 128-129.
Lowenheim, Fredereick A., (1978) "Electroplating," *McGraw-Hill Book Company*, p. 423.
Rose, Arthur et al., (1968) "The Condensed Chemical Dictionary," seventh edition, Reinhold Book Corporation, New York, p. 908.
Research Solutions & Resources, LLC [Webpage] "The Ag/AgCI Reference Electrode" (2014) pp. 1-3. [retrieved Sep. 30, 2018] <URL: http://www.consultrsr.net/resources/ref/agcl.htm>.
U.S. Office Action dated Jan. 13, 2020 issued in U.S. Appl. No. 15/416,448.
Chinese Third Office Action dated Jun. 18, 2019 issued in Application No. CN 201610156899.5.
Taiwan First Office Action dated Aug. 28, 2019 issued in Application No. TW 105108368.
Korean Second Office Action dated Apr. 24, 2019 issued in Application No. KR 10-2012-0050124.
Korean Decision for Grant dated Jun. 20, 2019 issued in Application No. KR 10-2012-0050124.
Chinese Fourth Office Action dated Mar. 6, 2020 issued in Application No. CN 201610156899.5.

| Reference Probe Shape | Relative Conductivity of Reference Electrode Compared to Plating Bath |
|---|---|
| 5-75° Arc | 200x and above |
| 75-150° Arc | 100x-200x |
| 150-240° Arc | 70x-100x |
| 240-300° Arc | 30x-70x |
| 300-360° Arc/Ring | 20x-50x |

FIG. 9C

CONTROL OF CURRENT DENSITY IN AN ELECTROPLATING APPARATUS

CROSS-REFERENCE TO RELATED APPLICATIONS

This application is a continuation of and claims priority to U.S. application Ser. No. 15/984,119, titled "CONTROL OF CURRENT DENSITY IN AN ELECTROPLATING APPARATUS," filed May 18, 2018, which is a divisional of Ser. No. 14/664,652 (issued as U.S. Pat. No. 10,011,917), titled "CONTROL OF CURRENT DENSITY IN AN ELECTROPLATING APPARATUS," filed Mar. 20, 2015, each of which is herein incorporated by reference in its entirety and for all purposes. U.S. application Ser. No. 14/664,652 is also a continuation-in-part of U.S. application Ser. No. 13/907,265 (issued as U.S. Pat. No. 9,309,604), titled "METHOD AND APPARATUS FOR ELECTROPLATING," filed May 31, 2013, which is a divisional of U.S. application Ser. No. 12/481,503 (issued as U.S. Pat. No. 8,475,636), titled "METHOD AND APPARATUS FOR ELECTROPLATING," filed Jun. 9, 2009, which is a continuation-in-part of U.S. application Ser. No. 12/291,356 (issued as U.S. Pat. No. 8,308,931), titled "METHOD AND APPARATUS FOR ELECTROPLATING," and filed Nov. 7, 2008.

BACKGROUND

One process frequently employed during fabrication of semiconductor devices is electroplating. For example, in copper damascene processes, electroplating is used to form copper lines and vias within channels that have previously been etched into a dielectric layer. Prior to the electrodeposition, a seed layer is deposited into the channels and on the substrate surface using, e.g., physical vapor deposition. Electroplating is then carried out on the seed layer to deposit a thicker layer of copper over the seed layer such that the channels are completely filled with copper. After electroplating, the excess copper can be removed by chemical mechanical polishing. Electroplating can also be used to deposit other metals and alloys, and can be used to form other types of features.

SUMMARY

Certain embodiments herein relate to methods and apparatus for electroplating. In one aspect of the embodiments herein, an apparatus for electroplating metal onto a substrate is provided, the apparatus including: a chamber for holding electrolyte; a substrate holder for holding the substrate in the chamber; and a reference electrode, where the reference electrode is (a) shaped like a ring, (b) shaped like an arc, (c) shaped to include multiple independent segments, and/or (d) designed to include a dynamically changeable shape.

For instance, in some embodiments the reference electrode is ring-shaped. In other cases, the reference electrode is arc-shaped. In some embodiments where an arc-shaped reference electrode is used, the arc of the reference electrode may span an angular extent between about 75-180°, or between about 105-150°.

The reference electrode may be positioned in a particular location with respect to the point at which the substrate first enters the electrolyte. In some embodiments, the reference electrode is positioned such that a center portion of the reference electrode is positioned proximate a substrate entry position. In some other embodiments, the reference electrode is positioned such that a center portion of the reference electrode is angularly offset from a substrate entry position, the angular offset being between about 30-90°.

In certain embodiments, the reference electrode may have a more complicated design. For instance, the reference electrode may be a multi-segment electrode including at least two segments that can be independently activated and/or deactivated. The activation/deactivation may occur during and/or after immersion. The apparatus may include a controller having instructions to (i) activate multiple segments of the multi-segment electrode before immersing the substrate in electrolyte, and (ii) independently de-activate one or more of the segments of the multi-segment electrode as the substrate is immersed in electrolyte. In some embodiments, the number of segments is between about 4-6. The space between adjacent segments may be between about 2.5-12.5 cm in some embodiments.

In certain embodiments, the reference electrode is designed to have a shape that is dynamically changeable to include at least a first shape and a second shape, the first and second shapes each being arc shapes, and the first and second shapes extending to different angular extents. The apparatus may further include a controller having instructions to change the shape of the reference electrode from the first shape to the second shape as the substrate is immersed in electrolyte. In some embodiments, the first shape extends to a greater angular extent than the second shape.

In another aspect of the disclosed embodiments, a method of electroplating metal onto a semiconductor substrate is provided, the method including: immersing the substrate in electrolyte in an electroplating chamber; monitoring a potential difference between the substrate and a reference electrode, where the reference electrode is (a) shaped like a ring, (b) shaped like an arc, (c) shaped to include multiple independent segments, and/or (d) designed to include a dynamically changeable shape; and electroplating metal onto the substrate.

In various embodiments, monitoring the potential difference between the substrate and the reference electrode includes controlling the potential difference between the substrate and the reference electrode during immersion. In some such cases, the potential difference between the substrate and the reference electrode is controlled to be substantially constant during immersion.

As noted above, in some embodiments the reference electrode is ring-shaped. In some such embodiments, the reference electrode may be between about 10×-50× as conductive as the electrolyte. The reference electrode may also be arc-shaped in some embodiments, for example with an arc that spans an angular extent between about 75-150° in some cases. The reference electrode may be between about 100×-200× as conductive as the electrolyte in some of these embodiments. Other shapes and relative conductivities may also be used in certain cases. For instance, in some implementations the reference electrode is arc-shaped and spans an angular extent between about 105-150°. The reference electrode may be between about 120-200× as conductive as the electrolyte in some of these examples. In another implementation, the reference electrode is arc-shaped, with the arc spanning an angular extent between about 150-240°. The reference electrode may be between about 70-100× as conductive as the electrolyte in some such cases.

The reference electrode may be positioned at various locations. In some embodiments, the reference electrode is positioned such that a center portion of the reference electrode is positioned proximate a substrate entry position. In some other embodiments, the reference electrode is positioned such that a center portion of the reference electrode is angularly offset from a substrate entry position, the angular offset being between about 30-90°. As mentioned, in some cases the reference electrode may have a more complex design. For instance, the reference electrode may be a multi-segment electrode including at least two segments that can be independently activated and/or deactivated, the method further including independently activating and/or deactivating the segments of the reference electrode. In some cases, the reference electrode is designed to have a shape that is dynamically changeable to include at least a first shape and a second shape, the first and second shapes each being arc shapes, and the first and second shapes extending to different angular extents, the method further including changing the shape of the reference electrode from the first shape to the second shape during immersion.

In another aspect of the disclosed embodiments, an apparatus for electroplating metal onto a substrate is provided, the apparatus including: a chamber for holding electrolyte; a substrate holder for holding the substrate in the chamber; and a reference electrode, where the reference electrode is between about 10×-225× as conductive as the electrolyte.

In some embodiments, the reference electrode is ring-shaped and the reference electrode is between about 10×-50× as conductive as the electrolyte. In some other embodiments, the reference electrode is arc-shaped, the arc of the reference electrode spanning an angular extent between about 75-150°, and the reference electrode is between about 100×-200× as conductive as the electrolyte. In certain other implementations, the reference electrode is arc-shaped, the arc of the reference electrode spans an angular extent between about 105-150°, and the reference electrode is between about 120×-200× as conductive as the electrolyte. In still other implementations, the reference electrode is arc-shaped, the arc of the reference electrode spanning an angular extent between about 150-240°, and the reference electrode is between about 70×-100× as conductive as the electrolyte. In some other cases, the reference electrode is arc-shaped, the arc of the reference electrode spans an angular extent between about 240-300°, and the reference electrode is between about 30×-70× as conductive as the electrolyte. In some other cases, the reference electrode is arc-shaped, the arc of the reference electrode spans an angular extent between about 300-359°, and the reference electrode is between about 20×-50× as conductive as the electrolyte.

In another aspect of the disclosed embodiments, a method of electroplating metal onto a semiconductor substrate is provided, the method including: immersing the substrate in electrolyte in an electroplating chamber; monitoring a potential difference between the substrate and a reference electrode, where the reference electrode is between about 10×-225× as conductive as the electrolyte; and electroplating metal onto the substrate.

In some embodiments, the reference electrode is ring-shaped and the reference electrode is between about 10×-50× as conductive as the electrolyte. In some other embodiments, the reference electrode may be arc-shaped. In some such embodiments, the arc of the reference electrode spans an angular extent between about 75-150°, and the reference electrode is between about 100×-200× as conductive as the electrolyte. In some cases, the arc of the reference electrode spans an angular extent between about 105-150°, and the reference electrode is between about 120×-200× as conductive as the electrolyte. In some other cases, the arc of the reference electrode spans an angular extent between about 150-240°, and the reference electrode is between about 70×-100× as conductive as the electrolyte. In still other embodiments, the arc of the reference electrode spans an angular extent between about 240-300°, and the reference electrode is between about 30×-70× as conductive as the electrolyte. In some cases, the arc of the reference electrode spans an angular extent between about 300-359°, and the reference electrode is between about 20×-50× as conductive as the electrolyte.

In a further aspect of the disclosed embodiments, an apparatus for electroplating metal onto a substrate is provided, the apparatus including: a chamber for holding electrolyte; a substrate holder for holding the substrate in the chamber; a reference electrode; and a controller having instructions for: immersing the substrate in the electrolyte at an angle such that a leading edge of the substrate contacts the electrolyte before a trailing edge of the substrate, the leading edge of the substrate first contacting the electrolyte at a substrate entry position, controlling a potential difference between the substrate and the reference electrode during immersion, and electroplating metal onto the substrate; where the reference electrode is positioned radially outside of the periphery of the substrate at a location that is angularly offset from the substrate entry position, the angular offset being between about 5-60°.

In certain embodiments, the reference electrode is a point reference electrode and the angular offset is between about 20-40°. For instance, the angular offset may be between about 25-35°.

In another aspect of the disclosed embodiments, a method of electroplating metal onto a substrate is provided, the method including: immersing the substrate in electrolyte in an electroplating chamber, where the substrate is immersed at an angle such that a leading edge of the substrate contacts the electrolyte before a trailing edge of the substrate, the leading edge of the substrate first contacting the electrolyte at a substrate entry position; monitoring a potential difference between the substrate and a reference electrode, where the reference electrode is positioned radially outside of the periphery of the substrate and angularly offset from the substrate entry position, the angular offset being between about 5-60°; and electroplating metal onto the substrate.

In certain embodiments, the reference electrode is a point reference electrode and the angular offset is between about 5-50°. In some such cases, the angular offset may be between about 20-40°.

These and other features will be described below with reference to the associated drawings.

BRIEF DESCRIPTION OF THE DRAWINGS

FIG. 9C is a table presenting possible ranges for the relative conductivity between the reference electrode and the electrolyte for differently shaped reference electrodes, according to certain embodiments.

DETAILED DESCRIPTION

Figure 1:
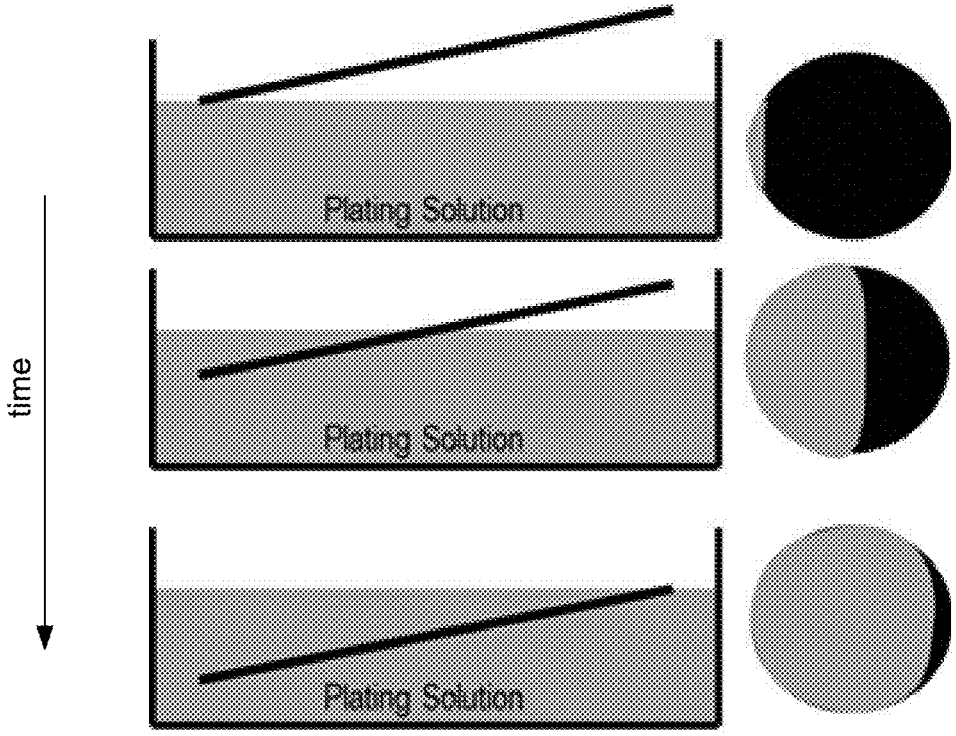
FIG. 1 illustrates a substrate being immersed in electrolyte through an angled immersion process.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The following detailed description assumes the embodiments are implemented on a wafer. However, the embodiments are not so limited. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

One of the challenges encountered in electroplating is to achieve a desired current density spatially over the face of the substrate and/or temporally over the course of an electroplating process. In various embodiments herein, a modified reference electrode may be used to promote a desired current density applied to the substrate during immersion/electroplating. By modifying the reference electrode using one or more of the techniques described herein, the potential difference between the substrate and the reference electrode can be measured and controlled more accurately, leading to improved electroplating results. The disclosed embodiments are useful in a variety of electroplating contexts including, but not limited to, electroplating copper, nickel, cobalt, and combinations thereof.

In a number of electroplating applications, a substrate may be immersed in electrolyte at an angle. Where this is the case, the leading edge of the substrate is immersed before the trailing edge of the substrate. In certain cases, the immersion occurs over a period having a duration on the order of about 120-200 ms. Angled immersion can reduce the likelihood that bubbles become trapped under the surface of the substrate, where they could deleteriously affect the deposition results. Angled immersion may have a variety of other benefits, as well. On the other hand, angled immersion can make it more difficult to control the current density distribution over the face of the substrate during immersion.

FIG. 1 illustrates a typical angled immersion of a substrate at three points in time and the corresponding immersed area of the substrate. In these wafer representations, the dark areas corresponds to areas of the wafer that have not yet been immersed, while the light areas correspond to the wafer's immersed area. In the upper portion of FIG. 1, the substrate is just beginning to enter the plating solution (the "leading edge" is immersed). In the middle portion of FIG. 1 the wafer is approximately half way immersed, and in the lower portion of FIG. 1 the substrate is almost fully immersed (the "trailing edge" is nearly immersed).

The electrical conditions applied to the substrate during immersion can have a strong effect on the resulting electroplated film. Various types of entry conditions may be used. In one example, often referred to as a "cold entry" or "zero current entry," no current is applied to the substrate until after the substrate is fully immersed. Unfortunately, cold entry processes often result in degradation (e.g., corrosion) of the seed layer on the substrate.

Corrosion of the seed layer during immersion may be mitigated by cathodically polarizing the seed layer with respect to the electrolyte solution. Cathodic polarization during immersion has been shown to provide significant metallization fill advantages as compared to immersion with no applied current. The cathodic polarization may be achieved in certain cases by pre-setting a power supply connected to the wafer to provide a small (sometimes constant) DC cathodic current at a current density in the range of, for example, about 0.02 to 5 $mA/cm^2$ just as, or as quickly as possible after, the wafer is first immersed in the electrolyte. Such methods are often referred to as "hot entry" methods. Hot entry typically results in a high current density applied to the leading edge of the substrate when the substrate first enters the plating solution, and a lower current density applied to the trailing edge of the substrate as the substrate finishes entering the plating solution.

In many applications, it is desirable to achieve a constant current density on immersed portions of the substrate during immersion. One method that has been used to promote a more uniform current density across the face of the substrate during immersion is potentiostatic entry. Where potentiostatic entry is used, a constant voltage is applied between the substrate and a reference electrode present in the electrolyte. The reference electrode is monitored by a power supply controller to provide a controlled potential between the reference electrode and the substrate. The substrate may also be referred to as the working electrode or cathode. The controller reads the potential from the reference electrode and adjusts the potential applied to the substrate as appropriate to maintain a controlled (constant in the case of potentiostatic entry) potential between the substrate and the reference electrode. In this way, the newly immersed area of a substrate faces a relatively constant voltage upon immersion, thereby reducing the variation in current density across the substrate during immersion. Polarization during entry is further discussed in U.S. Pat. Nos. 6,793,796; 6,551,483; 6,946,065; and 8,048,280, each of which is incorporated by reference herein in its entirety. In some implementations, the potentiostatic control during entry produces current densities of about 1 to 50 $mA/cm^2$ across the face of the wafer.

Reference electrodes are commonly used in electroplating systems. In various electroplating systems, a negative potential is applied to a substrate/cathode to thereby electroplate metal onto the substrate. An anode (also referred to as a counter electrode) completes the primary circuit in the electroplating cell and receives a positive potential during plating. The anode counterbalances the reaction occurring at the substrate where metal is deposited. The reference electrode serves to provide a direct measure of the potential of the electrolyte at a particular location (the location of the reference electrode).

A reference electrode draws negligible current and therefore does not create ohmic or mass transfer variations in the electrolyte close to the reference electrode. The reference electrode can be made to draw very little current by designing it to have a very high impedance.

In many conventional electroplating systems and certain electroplating systems herein, the reference electrode is designed such that it does not perturb the potential of the electrolyte where it resides. One factor that can contribute to this lack of perturbation is the size of the electrochemically active region on the reference electrode. For instance, point reference electrodes, sometimes referred to as point probes, include a small electrochemically active region and measure the potential of the electrolyte only at the exact location of the small electrochemically active region. Certain embodiments herein may utilize a point reference electrode. In a number of other embodiments, a different type of reference electrode may be used. In some cases, the reference electrode may have larger electrochemically active region(s) than conventional point reference electrodes. As such, in certain implementations the reference electrodes may influence the potential of the electrolyte over the region where the electrode is electrochemically active.

It has been observed that where potentiostatic entry is used, there can still be considerable differences in current density experienced by the leading edge of a substrate compared to that of the trailing edge. In many cases, the leading edge of a substrate experiences a higher current density than a trailing edge. Thus, while potentiostatic entry reduces the variation in current density during immersion, potentiostatic entry alone does not eliminate such variation. Further, it has been observed that potentiostatic entry processes are very sensitive to the design and condition of the hardware and substrate being used.

Figure 2A:
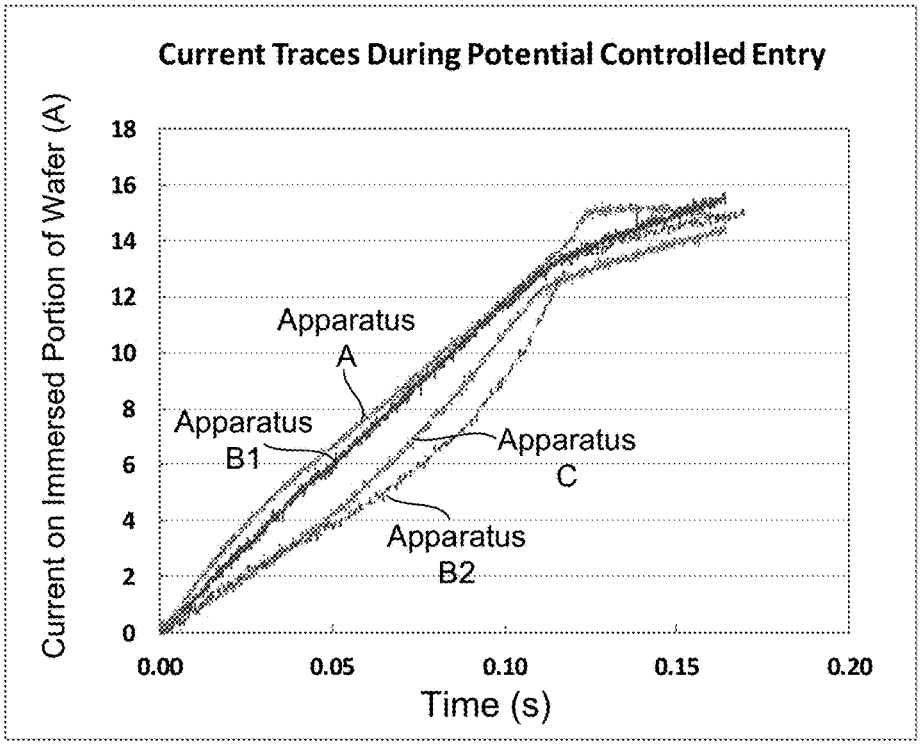
FIGS. 2A and 2B are graphs showing the current (FIG. 2A) and average current density (FIG. 2B) on immersed portions of a substrate during immersion, where different apparatus/entry conditions are used.
Figure 2B:
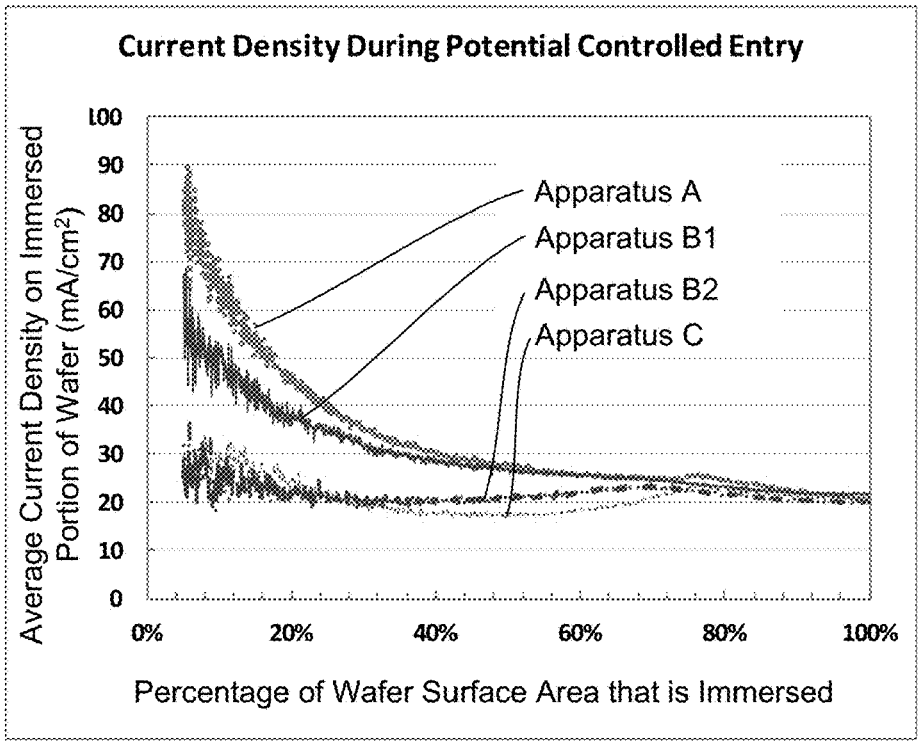

FIGS. 2A and 2B show the current and current density applied to a substrate over time as the substrate is immersed in electrolyte. The different lines shown in the figures relate to different types of electroplating apparatus (apparatus A, B, and C, with apparatus B being shown at two different sets of entry conditions, B1 and B2) at particular entry conditions. FIG. 2A shows the current applied over time during immersion. Ideally, the graph of current over time during immersion will have an S-shape. Where this is the case, the current increases most rapidly at the same time that the immersed area increases most rapidly (e.g., when the center of the substrate is being immersed), and the current density applied to the immersed substrate can be relatively stable. FIG. 2B shows the current density applied over the course of substrate immersion. Ideally, this graph is relatively flat and the applied current density is uniform over the course of immersion. The entry conditions used to generate the data in FIGS. 2A and 2B were all potentiostatic entry conditions, and the reference probe used to measure the potential applied to the substrate was a point probe. As shown in the figures, there is a considerable difference in the current and current density traces during immersion between different types of electroplating hardware and immersion conditions.

Various embodiments herein present methods and apparatus for achieving more controlled current density during electroplating, particularly during the immersion phase when a substrate is first immersed in electrolyte. Such embodiments permit the current density to be controlled to achieve, for example, either (a) uniform current density across the entire substrate, (b) a lower current density at the leading side of the substrate compared to the trailing side of the substrate, or (c) a higher current density at the leading side of the substrate compared to the trailing side of the substrate. In many cases, a controlled potential entry is used. In a controlled potential entry, the potential between the substrate and a reference electrode present in the electrolyte is controlled during immersion. In some cases the potential is controlled at a constant value, and the process is a potentiostatic entry process. Potentiostatic entry processes may be particularly relevant in the context of damascene plating. In other cases, the potential may be controlled such that it changes (e.g., increases, decreases, or a combination thereof) during immersion.

Though controlled potential entry has previously been used, the embodiments herein provide methods and apparatus for more accurately controlling the potential applied to the substrate. The potential applied to the substrate is measured based on the potential difference between the substrate and a reference electrode. In many embodiments herein, the characteristics of a reference electrode are modified to achieve more accurate control of the potential applied to the substrate. For example, in various embodiments one or more of the reference electrode's shape/size/design/location/material/conductivity may be modified from those used previously. These modifications to the reference electrode, alone or in combination with one another, help to more accurately control the potential applied to the substrate, and therefore help achieve more controlled current density over the face of the substrate and over the course of substrate immersion.

Figure 3:
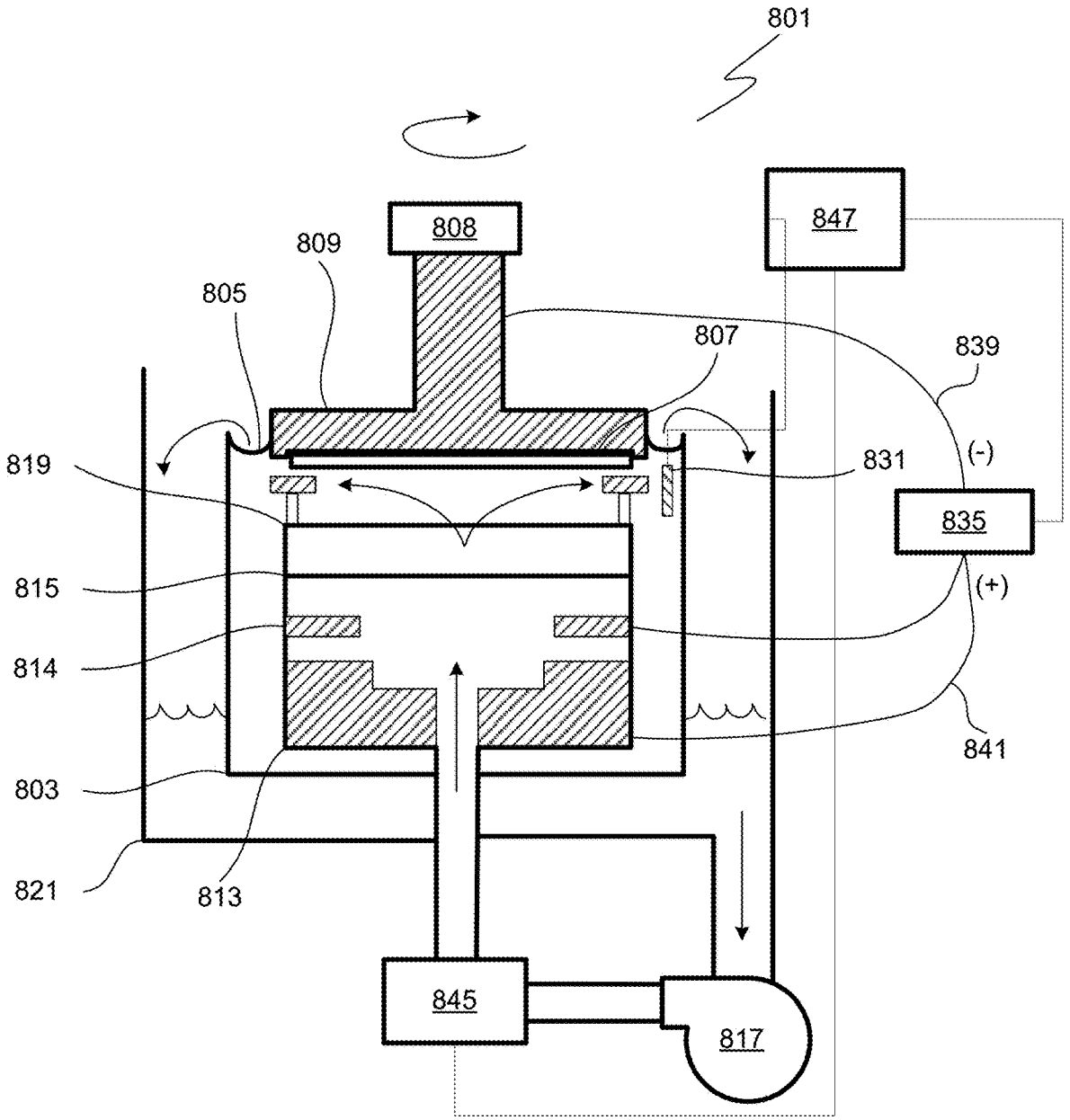
FIG. 3 shows a simplified view of an electroplating chamber with a recirculation loop for recycling electrolyte.

One example apparatus for performing electroplating is shown in FIG. 3. The apparatus includes one or more electroplating cells in which the substrates (e.g., wafers) are processed. Only a single electroplating cell is shown in FIG. 3 to preserve clarity. To optimize bottom-up electroplating, additives (e.g., accelerators and suppressors) may be added to the electrolyte; however, an electrolyte with additives may react with the anode in undesirable ways. Therefore anodic and cathodic regions of the plating cell are sometimes separated by a membrane so that plating solutions of different composition may be used in each region. Plating solution in the cathodic region is called catholyte; and in the anodic region, anolyte. A number of engineering designs can be used in order to introduce anolyte and catholyte into the plating apparatus.

Referring to FIG. 3, a diagrammatical cross-sectional view of an electroplating apparatus 801 is shown for context. The plating bath 803 contains the plating solution, which is shown at a level 805. The catholyte portion of this vessel is adapted for receiving substrates in a catholyte. A wafer 807 is immersed into the plating solution and is held by, e.g., a "clamshell" holding fixture 809, mounted on a rotatable spindle 811, which allows rotation of clamshell 809 together with the wafer 807. A general description of a clamshell-type plating apparatus having aspects suitable for use with the embodiments herein is included in U.S. Pat. Nos. 6,156,167 and 6,800,187, which are each incorporated herein by reference in their entireties.

An anode 813 is disposed below the wafer within the plating bath 803 and may be separated from the wafer region by a membrane 815, preferably an ion selective membrane. For example, Nafion™ cationic exchange membrane (CEM) may be used. The region below the anodic membrane is often referred to as an "anode chamber." The ion-selective anode membrane 815 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299, both incorporated herein by reference in their entireties. Ion exchange membranes, such as cationic exchange membranes are especially suitable for these applications. These membranes are typically made of ionomeric materials, such as perfluorinated co-polymers containing sulfonic groups (e.g. Nafion™), sulfonated polyimides, and other materials known to those of skill in the art to be suitable for cation exchange. Selected examples of suitable Nafion™ membranes include N324 and N424 membranes available from Dupont de Nemours Co.

During plating the ions from the plating solution are deposited on the substrate. The metal ions must diffuse through the diffusion boundary layer and into the recessed feature (if present). A typical way to assist the diffusion is through convection flow of the electroplating solution provided by the pump 817. Additionally, a vibration agitation or sonic agitation member may be used as well as wafer rotation. For example, a vibration transducer 808 may be attached to the wafer chuck 809.

The plating solution is continuously provided to plating bath 803 by the pump 817. In various embodiments, the plating solution flows upwards through an anode membrane 815 and a diffuser plate 819 to the center of wafer 807 and then radially outward and across wafer 807. The plating solution also may be provided into the anodic region of the bath from the side of the plating bath 803. The plating solution then overflows plating bath 803 to an overflow reservoir 821. The plating solution is then filtered (not shown) and returned to pump 817, completing the recirculation of the plating solution. In certain configurations of the plating cell, a distinct electrolyte is circulated through the portion of the plating cell in which the anode is contained while mixing with the main plating solution is prevented using sparingly permeable membranes or ion selective membranes.

A reference electrode 831 is typically employed, especially when electroplating at a controlled potential is desired. The reference electrode 831 may be one of a variety of reference electrodes as disclosed herein. A contact sense lead in direct contact with the wafer 807 may be used in some embodiments, in addition to the reference electrode, for more accurate potential measurement (not shown).

In many current designs, the reference electrode 831 is a point probe (i.e., rod) that measures the potential of the plating bath 803 at a particular point/location. The reference electrode 831 is sometimes located to measure the electrolyte potential very near the point at which the substrate first enters the plating bath 803. In some cases, for instance, the reference electrode 831 measures the potential of the plating bath at a location that is within about 1 inch of where the substrate first enters the plating bath. In other cases, the reference electrode 831 may measure potential at a location that is more removed from the substrate, for example at a location that is deep within the plating bath 803. Alternatively, in some embodiments the reference electrode 831 is located on the outside of the plating bath 803 in a separate chamber (not shown), which chamber is replenished by overflow from the main plating bath 803.

In various cases, the reference electrode is a high impedance electrode that exhibits a stable potential in solution to provide a reference potential/standard potential against which the potential applied to the substrate can be measured. Common types of electrodes that may be used in aqueous systems include, for example, mercury-mercurous sulfate electrodes, copper-copper(II) sulfate electrodes, silver chloride electrodes, saturated calomel electrodes, standard hydrogen electrodes, normal hydrogen electrodes, reversible hydrogen electrodes, palladium-hydrogen electrodes, and dynamic hydrogen electrodes. Other materials and combinations of materials may also be used. In some cases the reference electrode includes a titanium member (e.g., a rod, arc, or ring) that is covered with copper on at least one surface (in some cases at least the upper surface) of the member. In these or other cases, the reference electrode may include a core of an electrically insulating material covered with a layer of electrically conductive material.

Oftentimes in conventional electroplating systems the reference electrode is vertically oriented (e.g., a vertical rod), with an upper surface positioned within the electrolyte. In many cases, the potential is measured at this upper surface, which may in some cases be positioned within about 1 inch of the surface of the electrolyte. An example length of a rod-shaped electrode is about 2 inches, though this length is not critical.

In some embodiments the reference electrode chamber is connected via a capillary tube or by another method, to the side of the wafer substrate or directly under the wafer substrate. In some embodiments, the apparatus further includes contact sense leads (not shown) that connect to the wafer periphery and which are configured to sense the potential of the metal seed layer at the periphery of the wafer but do not carry any current to the wafer.

An additional electrode (not shown) may be provided in various embodiments. The additional cathode may be referred to as a dual cathode, a thief cathode, or an auxiliary cathode in certain cases. The dual cathode is often annularly shaped, and may be provided in a dual cathode chamber that may be located outside the main portion of an electroplating chamber, for example separated from the main plating bath 803 by a membrane. Often the dual cathode is positioned such that it is radially outside of the periphery substrate when the substrate is engaged in the substrate holder. In terms of its vertical position, the dual cathode may be located proximate the substrate, or between the substrate and the anode. The dual cathode can affect how current flows through the electroplating apparatus to help promote uniform plating results across the face of the substrate. Electroplating apparatus utilizing additional electrodes are further described in U.S. Pat. Nos. 8,475,636 and 8,858,774, each of which is herein incorporated by reference in its entirety. In certain cases, the reference potential can be impacted by the presence of a dual cathode (or other additional electrode). Another factor that can make it difficult to measure the relevant potential difference is the distance between the point at which the reference electrode measures the potential and the point at which the substrate enters the electrolyte. In certain contexts, larger separation distances between these two points lead to less useful measurements.

A DC power supply 835 can be used to control current flow to the wafer 807. The power supply 835 has a negative output lead 839 electrically connected to wafer 807 through one or more slip rings, brushes and contacts (not shown). The positive output lead 841 of power supply 835 is electrically connected to an anode 813 located in plating bath 803. The power supply 835, a reference electrode 831, and a contact sense lead (not shown) can be connected to a system controller 847, which allows, among other functions, modulation of current and potential provided to the elements of electroplating cell. For example, the controller may allow electroplating in potential-controlled and current-controlled regimes. The controller may include program instructions specifying current and voltage levels that need to be applied to various elements of the plating cell, as well as times at which these levels need to be changed. The controller can control the potential applied to the substrate by continuously monitoring the difference in potential between the substrate and the reference electrode, making adjustments as needed to drive the electrodeposition as desired. When forward current is applied, the power supply 835 biases the wafer 807 to have a negative potential relative to anode 813. This causes an electrical current to flow from anode 813 to the wafer 807, and an electrochemical reduction reaction occurs on the wafer surface (the cathode), which results in the deposition of the electrically conductive layer (e.g. copper, nickel, cobalt, etc.) on the surfaces of the wafer. An inert anode 814 may be installed below the wafer 807 within the plating bath 803 and separated from the wafer region by the membrane 815.

The apparatus may also include a heater 845 for maintaining the temperature of the plating solution at a specific level. The plating solution may be used to transfer the heat to the other elements of the plating bath. For example, when a wafer 807 is loaded into the plating bath the heater 845 and the pump 817 may be turned on to circulate the plating solution through the electroplating apparatus 801, until the temperature throughout the apparatus becomes substantially uniform. In one embodiment the heater is connected to the system controller 847. The system controller 847 may be connected to a thermocouple to receive feedback of the plating solution temperature within the electroplating apparatus and determine the need for additional heating.

The controller will typically include one or more memory devices and one or more processors. The processor may include a CPU or computer, analog and/or digital input/output connections, stepper motor controller boards, etc. In certain embodiments, the controller controls all of the activities of the electroplating apparatus and/or of a pre-wetting chamber used to wet the surface of the substrate before electroplating begins. The controller may also control all the activities of an apparatus used to deposit a seed layer, as well as all of the activities involved in transferring the substrate between the relevant apparatus.

Typically there will be a user interface associated with controller 847. The user interface may include a display screen, graphical software displays of the apparatus and/or process conditions, and user input devices such as pointing devices, keyboards, touch screens, microphones, etc.

The computer program code for controlling electroplating processes can be written in any conventional computer readable programming language: for example, assembly language, C, C++, Pascal, Fortran or others. Compiled object code or script is executed by the processor to perform the tasks identified in the program. It should be understood that the disclosed methods and apparatus are useful in many different types of electroplating contexts. For example, the disclosed techniques can be applied to plating various types of metal and alloys, and can be practiced in many different types of electroplating cells having varying hardware setups. As such, while many of the embodiments are presented herein in the context of plating particular metals in particular electroplating cells, the embodiments are not so limited. It is expected that the disclosed embodiments can be used to improve nearly any type of electroplating results, though the embodiments are particularly beneficial in the context of flat and/or disc-shaped substrates such as semiconductor wafers.

As noted above, in various embodiments herein a reference electrode may be modified to more accurately measure and control the potential applied to the substrate.

Shape of Reference Electrode

Figure 4A:
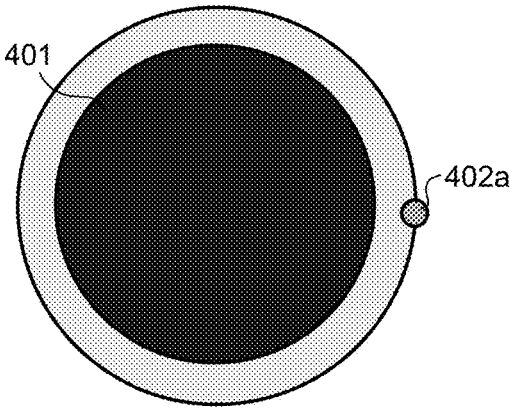
FIGS. 4A-4D and 5A-5D illustrate differently shaped reference electrodes that may be used in certain embodiments.
Figure 4B:
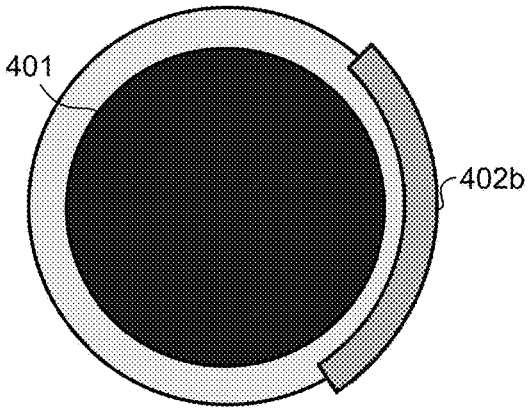
Figure 4C:
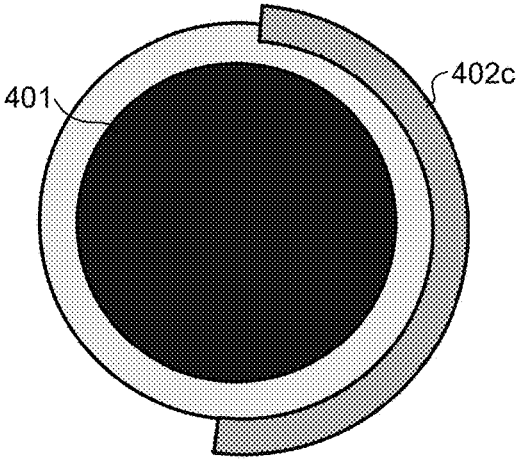
Figure 4D:
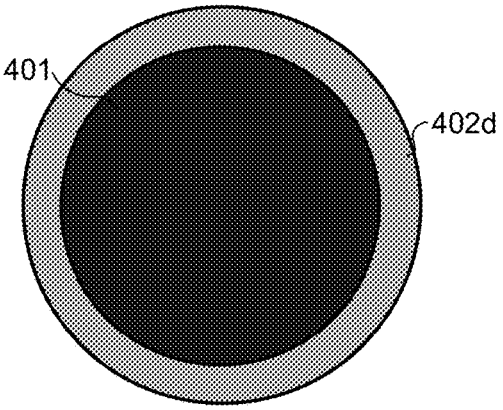

In many conventional electroplating applications, the reference electrode is a point electrode (also referred to as a point probe). A point reference electrode provides a standard potential measurement of the solution at the particular point where the reference electrode is located. FIGS. 4A-4D present top-down views of four alternative reference electrode designs that may be used in various embodiments. The reference electrode 402*a* of FIG. 4A is a point electrode, the reference electrode 402*b* of FIG. 4B is a quarter ring electrode (also referred to as a 90° arc electrode), the reference electrode 402*c* of FIG. 4C is a half ring electrode (also referred to as a 180° arc electrode), and the reference electrode 402*d* of FIG. 4D is a full ring electrode. In each figure, the wafer is shown as element 401. Three different basic types of reference electrode shapes are shown: point electrodes (FIG. 4A), arc/partial ring electrodes (FIGS. 4B and 4C), and full ring electrodes (FIG. 4D). With respect to the arc/partial ring electrodes, the electrode can be shaped to span any angular extent. In other words, the embodiments are not limited to the particular 90° or 180° arcs shown in the figures, and arcs that span less than 90°, between 90-180°, and even arcs that are greater than 180° are contemplated to be within the scope of the present embodiments. Particular arc shapes that work especially well for electroplating a semiconductor wafer are discussed further below.

In various embodiments, the reference electrode may be positioned/centered near the point where the substrate first enters the electrolyte. In other embodiments, the reference electrode may be positioned/centered at a location that is offset from the point at which the substrate first enters the electrolyte, as described further below.

By using such alternative reference electrode shapes, the reference electrode can be used to provide a standard potential measurement across a wider region in the plating cell. In effect, the reference electrode can be shaped to provide an average potential over a region of the plating cell, rather than a specific potential at a single spot within the plating cell. This can help counteract local variations in potential within the plating solution to help achieve a more accurate measure of the potential being applied to the substrate. In various embodiments, the reference electrode may be positioned such that it is radially outside of the periphery of the substrate during plating, for example separated from the periphery of the substrate by a horizontal distance of about 1 inch or less.

FIGS. 5A-5D illustrate perspective views of the reference electrodes 402*a*-402*d* from FIGS. 4A-4D positioned in an electroplating cell 510 having a plating bath therein (not shown). Details of the electroplating cell 510 are omitted for the sake of clarity. As shown in FIGS. 5A-5D, the point reference electrode 402*a* is shaped like a rod, and the reference electrodes 402*b*-402*d* are shaped like curving sheets (e.g., copper sheets, though other materials may also be used).

Figure 6:
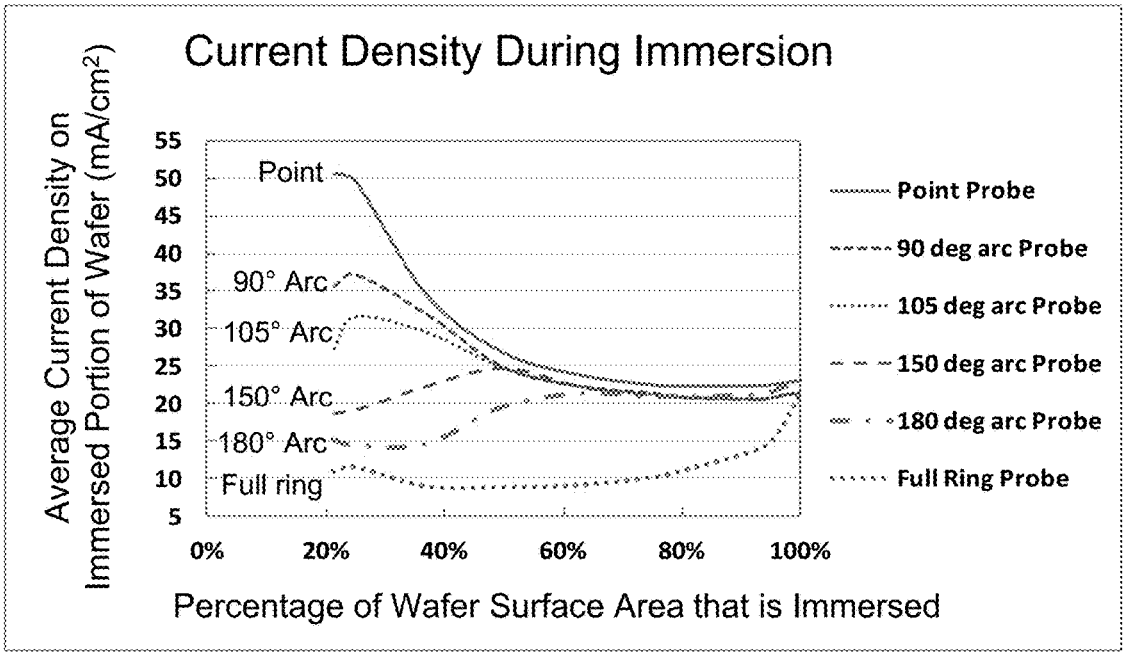
FIGS. 6 and 7 are graphs illustrating modeling results (FIG. 6) and experimental results (FIG. 7) related to the average current density applied to immersed portions of a substrate over time during immersion, where reference electrodes of various shapes are used.

FIG. 6 presents modeling results predicting the average current density applied to the immersed area of a substrate over the course of immersion where differently shaped reference electrodes are used. In particular, six different reference electrode shapes are explored: a point reference electrode (e.g., the reference electrode 402*a* of FIG. 4A), a 90° arc reference electrode (e.g., the quarter ring reference electrode 402*b* of FIG. 4B), a 105° arc reference electrode, a 150° arc reference electrode, a 180° arc reference electrode (e.g., the half ring reference electrode 402*c* of FIG. 4C), and a full ring electrode (e.g., the full ring electrode 402*d* of FIG. 4D). The data in FIG. 6 was generated using a finite element model with FlexPDE, assuming that a potentiostatic entry is used.

Figure 7:
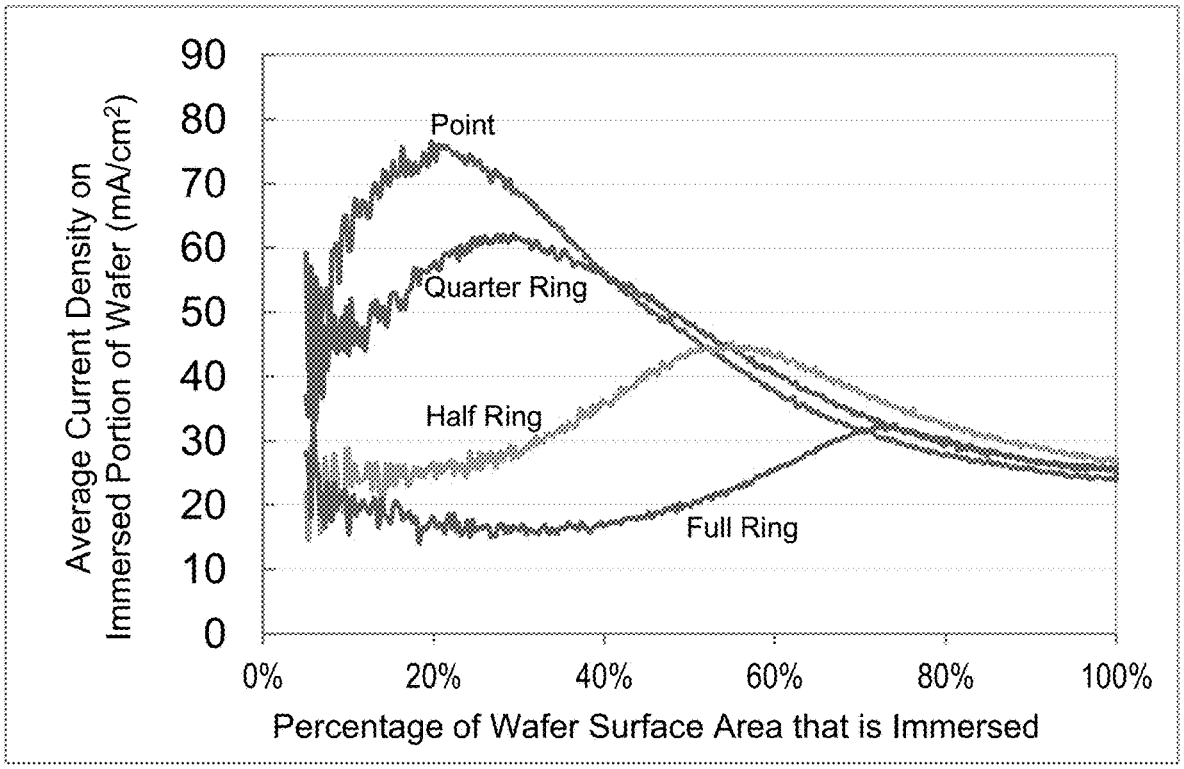

FIG. 7 presents experimental results showing the average current density applied to the immersed area of the substrate over the course of a potentiostatic immersion where differently shaped reference electrodes are used. The data shown relates to the reference electrodes 402*a*-402*d* in FIGS. 4A-4D. Specifically, the data show the average current density over the immersed area where the reference electrode is either a point reference electrode, a quarter ring reference electrode, a half ring reference electrode, or a full ring reference electrode.

Ideally in some embodiments, the current density is constant over time during immersion. In other words, it is desirable for the curves shown in FIGS. 6 and 7 to be relatively flat. The modeling and experimental results presented in FIGS. 6 and 7 show that the shape of the reference electrode can have a significant impact on the average current density experienced by the substrate over time during immersion. In particular, where a point reference electrode is used, the current density applied to immersed areas of the substrate initially rises to a high level, then drops off over the course of immersion. The current density in this example changes by a factor of about 3 during immersion, which is far from ideal. By contrast, where the other reference electrode shapes are used, the current density changes to a lesser degree during immersion, thereby achieving a more uniform average current density applied to the substrate over the course of immersion. For example, where a quarter ring reference electrode is used, the current density changes by a factor of about 2.5 during immersion, and where a half ring reference electrode is used the current density changes by a factor of only about 1.7 during immersion. The full ring reference electrode resulted in a slight dip in current density over the first 40% of immersion, followed by a slight rise and then another gradual fall in current density. Though these results suggest that the full ring reference electrode may result in an entry that is too "cold," certain other measures may be taken to promote improved results with a full ring reference electrode, as discussed further below with respect to FIG. 9A, for instance. As such, in certain cases full ring reference electrodes are expected to promote improved results, and are considered to be within the scope of the disclosed embodiments.

Figure 5A:
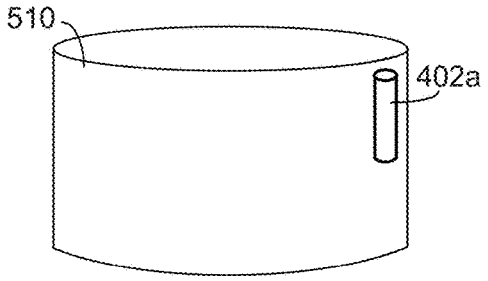
Figure 5B:
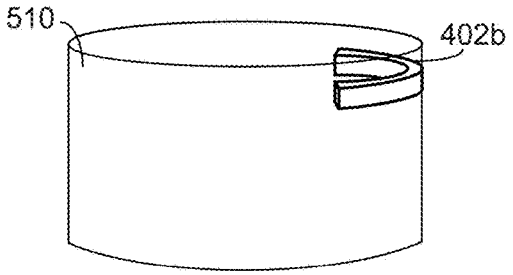
Figure 5C:
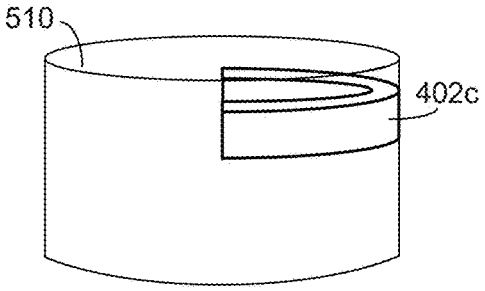
Figure 5D:
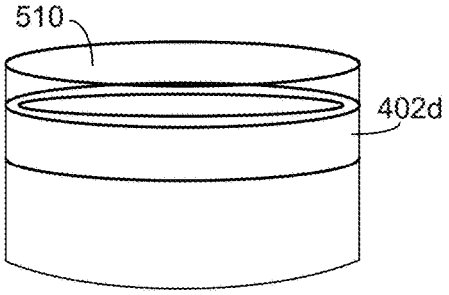

Generally, reference electrodes that span a longer distance/angular extent along the perimeter of the substrate/electroplating cell are better able to prevent a spike in the average current density applied to the substrate during the initial portion of the immersion process. However, at some point the reference electrode may span a greater length/angular extent than is ideal, and the current density over the initial portion of immersion may maintained at a level that is lower than desired. In certain embodiments, therefore, the reference electrode is an arc that spans between about 50-200°, for example between about 70-180°, or between about 105-150° around the substrate. Oftentimes, the reference electrode is shaped/sized to be positioned radially outside of the periphery of the substrate during electroplating, as shown in FIGS. 4A-4D. Where the reference electrode is a sheet of material (as shown in FIGS. 5B-5D, for instance), the thickness of the sheet may be between about 1-5 mm, or between about 1-3 mm. The height of the reference electrode may in certain cases be between about 0.5-2 inches. The height is measured vertically in FIGS. 5A-5D, and into/out of the page in FIGS. 4A-4D.

Without wishing to be bound by theory, it is believed that the arc- and ring-shaped reference electrodes provide more uniform current density during immersion because these electrodes can be used to measure the potential over an entire region within the plating cell, rather than measuring the potential at one specific spot in the plating cell. This provides an average reference voltage, thereby overcoming certain local potential variations and permitting more accurate control over the potential applied to the substrate. Local variations in potential within the plating cell can arise during immersion, particularly where tilted immersion is used such that one side of the substrate enters the plating solution before the other side of the substrate. In this case, the leading edge of the substrate can be understood to "activate" the electrolyte where the immersion first occurs, while electrolyte near the other side of the plating cell remains "unactivated" during this initial portion of the immersion process. Because the voltage distribution within the electrolyte is not spatially uniform during immersion, the use of an arc- or ring-shaped reference electrode can help achieve uniform current density on the substrate by utilizing an average reference voltage over a relevant region, thereby minimizing any effects seen from the non-uniform voltage distribution within the electrolyte.

Further, the shape of the reference electrode can itself affect the voltage distribution within the electroplating cell. Because the reference electrode is generally made from a conductive material and includes a surface that is equipotential, the electrode (if shaped appropriately) can operate to impart its potential over a wide area of the electrolyte within the cell (the area being about coextensive with the reference electrode). For example, modeling results suggest that where a full ring reference electrode is used, the potential distribution within the cell is more uniform compared to cases where a point reference electrode is used. The full ring reference electrode establishes a more angularly uniform potential distribution compared to the point reference electrode. With the point reference electrode, the voltage near the point at which the substrate first enters electrolyte can differ considerably from the voltage on the opposite side of the electroplating cell. Arc-shaped reference electrodes can similarly affect the potential distribution within the electroplating cell.

Another factor which may lead to the improved control over current density is the fact that substrates are often rotated during immersion. Such rotation can result in a changing distance between the reference electrode and the closest immersed portion of the substrate over the course of immersion. For instance, the reference electrode may be positioned proximate the location where the leading edge of the substrate first enters electrolyte. As the substrate is immersed, it may also be rotated, which may increase the distance between a point reference electrode and the immersed portion of the substrate. Faster rotation speeds exacerbate this effect. To compare, this effect may be less problematic where the reference electrode is arc-shaped, since the distance between the reference electrode and the immersed portion of the substrate may be maintained constant for a certain period of time as the substrate is rotated.

In certain embodiments, the reference electrode may have a shape that is more complicated. For instance, in some cases the reference electrode may be made of various segments. In these or other cases, the reference electrode may have a dynamic shape that can be changed during an electroplating process, or between electroplating processes. Reference electrodes having multiple segments and/or a dynamically changeable shape are further discussed below.

Location of Reference Electrode

In various electroplating applications, the reference electrode is positioned at a spot that is close to the point at which the substrate first enters the electrolyte. The point at which the leading edge of a substrate first enters electrolyte is also referred to as the substrate entry point or substrate entry position. Both modeling and experimental results have shown that the location at which the reference electrode is positioned relative to the substrate entry point can have a significant impact on the current density applied to the substrate over the course of immersion. As such, in certain embodiments the reference electrode may be positioned at a location that is separated from the substrate entry point. Often this separation is angular. In other words, the reference electrode may be positioned at a location that would be near the periphery of the substrate (if the substrate were fully immersed), the location being angularly offset from the point at which the substrate first enters electrolyte by at least a specified angular degree.

Figure 8A:
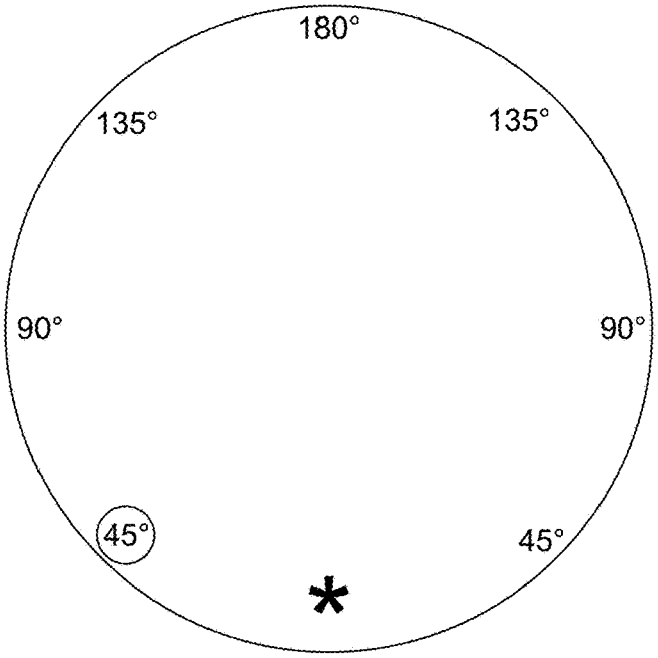
FIG. 8A is a top-down view of an electroplating chamber illustrating various offset angles at which a reference electrode may be placed according to certain embodiments.

FIG. 8A illustrates a simplified top down view of an electroplating cell. The asterisk (*) represents the point at which the leading edge of a tilted substrate first enters electrolyte (the substrate entry point). Several angular locations around the electroplating cell are also shown to illustrate various possible locations at which the reference electrode may be placed. These locations are labeled by their angular offset from the substrate entry position. These locations are non-limiting and are shown merely to clarify what is meant by the described angular offset. As shown, in various embodiments the offset angle may be in either direction. In certain embodiments, the reference electrode may be located at a position where the leading edge of the substrate will approach the location of the reference electrode after the substrate first enters the electrolyte. In other words, the reference electrode may be offset from the substrate entry position in the same direction as substrate rotation. In one such example, the substrate rotates in a clockwise manner, the substrate first enters electrolyte at the asterisk, and the reference electrode is located at the 45° mark that is in a small circle in FIG. 8A. In another implementation, the reference electrode may be located at a position where the leading edge of the substrate will move away from the position at which the substrate first enters electrolyte. In other words, the reference electrode may be offset form the substrate entry position in the opposite direction in which the substrate is rotated. In one example of this embodiment, the substrate rotates in a counterclockwise manner, the substrate enters the electrolyte at the asterisk, and the reference electrode is positioned at the 45° mark that is in the small circle in FIG. 8A. As compared to the example above, the substrate rotates in the opposite direction (away from the reference electrode instead of towards it).

While much of the discussion herein regarding the relative location of the reference electrode compared to the substrate entry position is provided in the context of a point reference electrode, the embodiments are not so limited. Arc-shaped reference electrodes may also be centered such that they are angularly offset from the wafer entry location. The position of an arc-shaped reference electrode is considered to be the point on the electrode that is equidistant from each end of the arc (the middle of the arc).

Figure 8B:
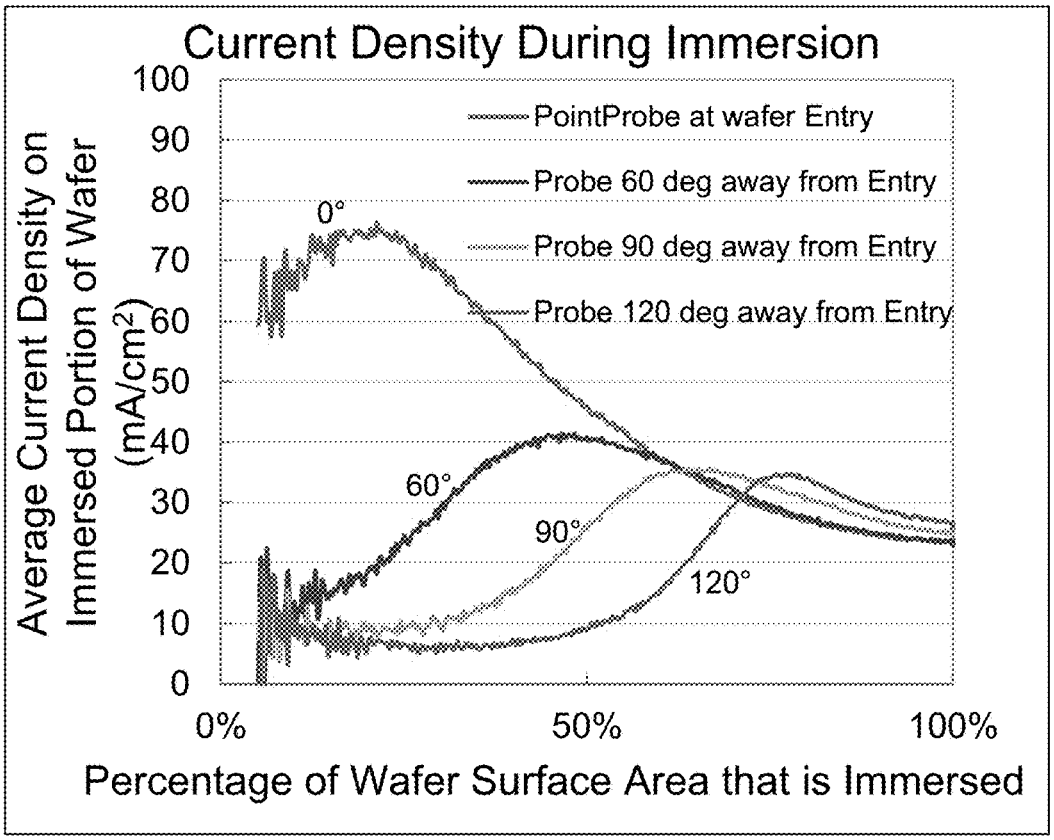
FIGS. 8B-8D show experimental results related to the average current density (FIGS. 8B and 8D) and the current (FIG. 8C) applied to the immersed portion of a substrate over the course of immersion, where a point reference electrode is positioned at various offset angles from the substrate entry position.
Figure 8C:
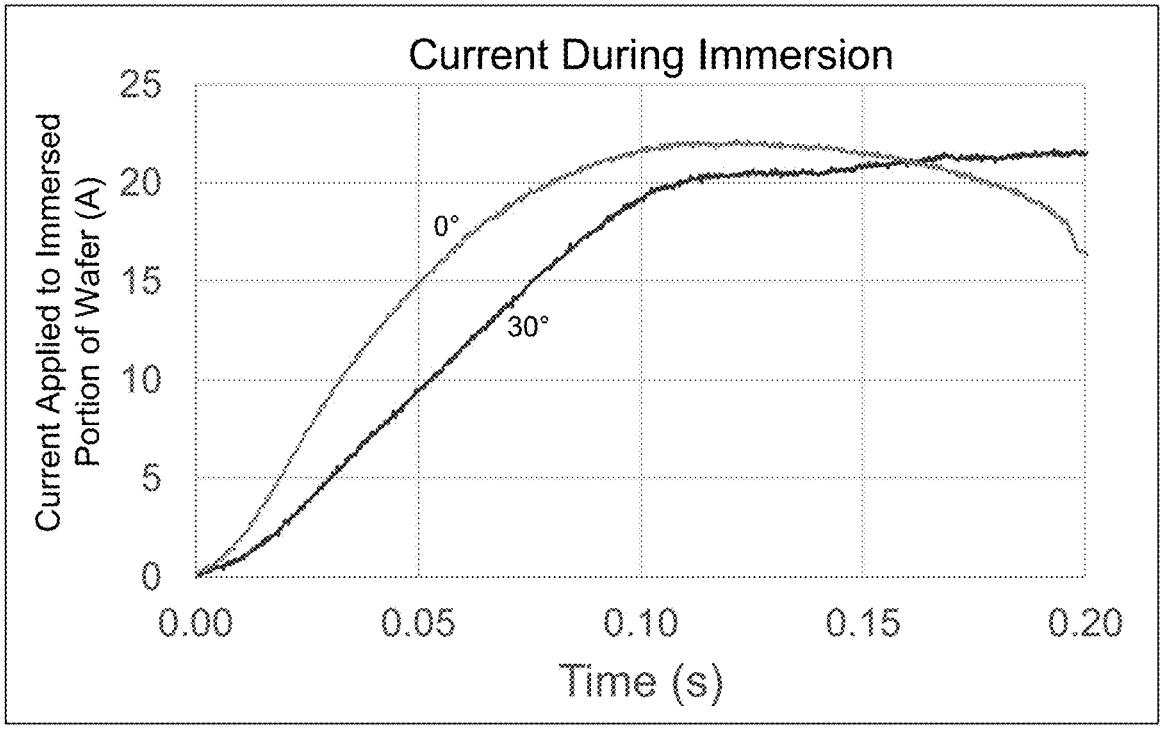
Figure 8D:
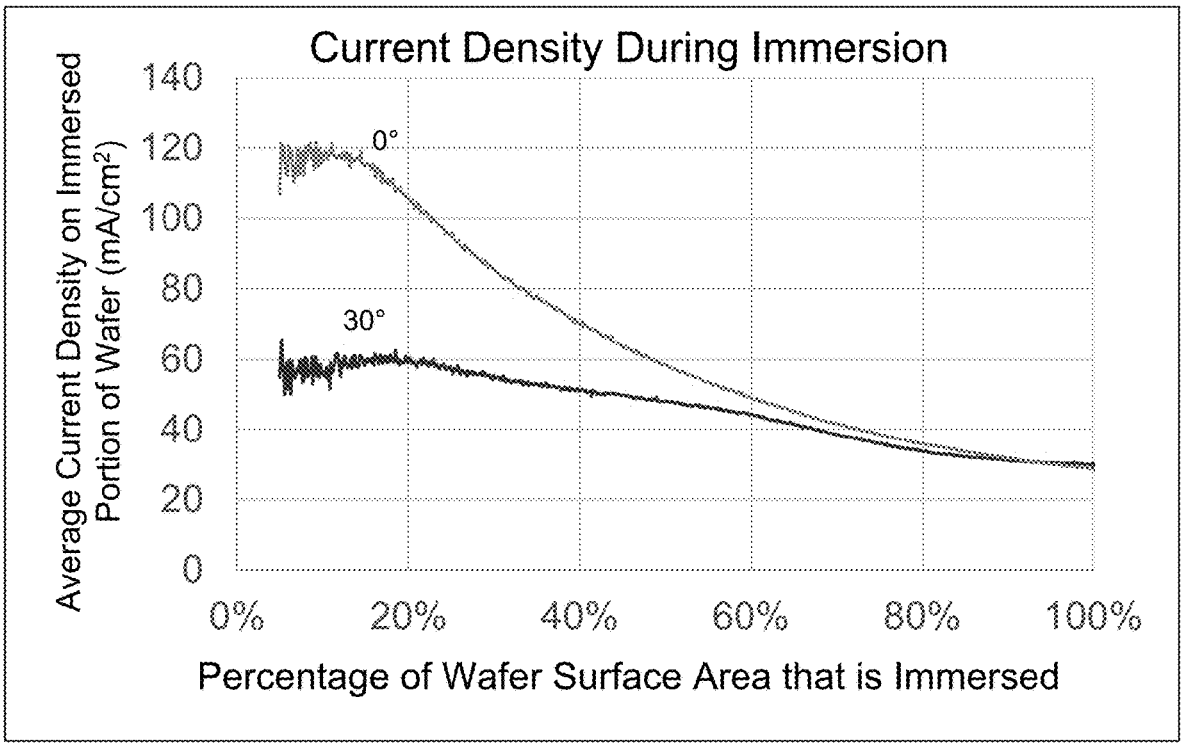

FIGS. 8B-8D present experimental results showing the current (FIG. 8C) and average current density (FIGS. 8B and 8D) applied to the immersed area of a substrate over the course of substrate immersion where different reference probe locations are used. The data in FIGS. 8B-8D were generated using a point reference electrode such as electrode 402*a* of FIGS. 4A and 5A.

With respect to FIG. 8B, the experimental results confirm the expected current density profile where the reference electrode is located proximate the substrate entry position (where the offset angle is 0°). The results also show that an offset angle of 60° or greater results in an initial current density that is undesirably low under the conditions used to perform the experiment. Offset angles of 60° or more may be more appropriate in certain other embodiments. FIGS. 8C and 8D present additional experimental results for a case where the reference electrode is angularly offset from the substrate entry position to a lesser degree than the cases shown in FIG. 8B. In particular, FIGS. 8C and 8D compare a case where the reference electrode is positioned proximate the substrate entry position (an offset of 0°) to a case where the reference electrode is angularly offset from the substrate entry position by about 30°. As shown in FIG. 8C, the current rises more slowly in the case where the reference electrode is slightly offset from the substrate entry position. As shown in FIG. 8D, this more gradual rise results in a more uniform average current density applied to the substrate over the course of immersion. This improvement is substantial and unexpected.

In certain embodiments, the reference electrode may be positioned such that it is angularly offset from the substrate entry position by an angle between about 5-50°, or by an angle between about 10-45°, or by an angle between about 20-40°, or by an angle between about 25-35°. In a particular embodiment the reference electrode is angularly offset from the substrate entry position by about 30°. Offset angles outside these ranges may also be used. The reference electrode may be positioned radially outside of the periphery of the substrate. In some cases the reference electrode may be positioned directly within the plating cell such that it is exposed to the same electrolyte that contacts the substrate. In other cases the reference electrode may be positioned such that it is separated from the electrolyte that contacts the substrate, for example the reference electrode may be positioned in a reference electrode chamber that may be separated (e.g., by a membrane) from the electrolyte that contacts the substrate. In many cases the reference electrode is positioned radially outside of the periphery of the substrate. Often, but not always, the reference electrode is positioned such that it is immersed in the electrolyte, the top surface of the electrode being about 2 inches or less from the electrolyte-air interface, for example about 1 inch or less.

The location of the reference electrode may be static in some cases. In other cases, the location of the reference electrode may change, for example between processing different substrates, or even during processing of a single substrate. Further details related to a movable reference electrode are included below.

Conductivity of Reference Electrode

The conductivity of the reference electrode can also affect the uniformity of the average current density applied to the substrate over the course of substrate immersion. In particular, the relative conductivity of the reference electrode compared to the conductivity of the plating bath is relevant. These conductivities can be directly compared as they have the same units (e.g., S/cm), though the conductivity of the reference electrode refers to an electronic conductivity and the conductivity of the plating bath refers to an ionic conductivity.

Figure 9A:
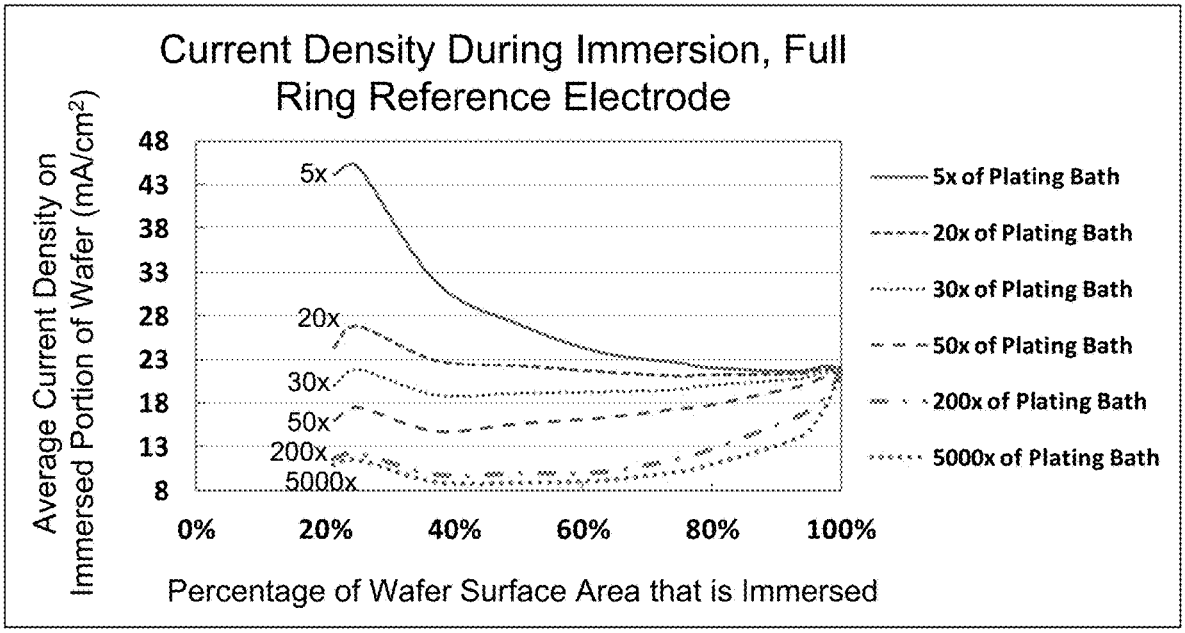
FIG. 9A is a graph showing modeling results related to the average current density applied to the immersed portion of a substrate over the course of immersion where a full-ring shaped reference electrode with different relative conductivities with respect to the electrolyte are used.

FIG. 9A presents modeling results generated to show the average current density applied to the immersed area of a substrate vs. the percentage of the substrate that is immersed. In other words, FIG. 9A predicts the average current density applied to a substrate over the course of immersion. The results in FIG. 9A were generated assuming that the reference electrode is a full ring electrode like that shown in FIGS. 4D and 5D.

The results in FIG. 9A show that the relative conductivity of the reference electrode compared to the plating bath can have a substantial effect on the uniformity of the average current density applied to the substrate over the course of immersion. Where the reference electrode is 5× as conductive as the plating bath, the current density starts off relatively high, dropping fairly steeply as the substrate is further immersed. Comparatively, where the reference electrode is 30× as conductive as the plating bath, the average current density is much more uniform over the course of immersion. At the other end of the scale, where the reference electrode is 5000× as conductive as the plating bath, the average current density starts out relatively low, climbing to its final value as the final 20% of the substrate is immersed. Generally, the best results were predicted in cases where the reference electrode was between about 10×-50× as conductive as the plating bath, for example between about 15×-40× as conductive as the plating bath, or between about 20×-35× as conductive as the plating bath. These ranges are particularly appropriate for reference electrodes that are shaped like full ring electrodes, though they may also apply to reference electrodes of other shapes (e.g., rods and/or arcs). However, reference electrodes of other shapes may have different optimal relative conductivities compared to the plating bath.

As used herein, a relative reference electrode conductivity of Ax compared to the plating bath means that the reference electrode has a conductivity that is about A times that of the plating solution. Similarly, a relative reference electrode conductivity of Ax-Bx compared to the plating bath means that the reference electrode has a conductivity between about A-B times the conductivity of the plating bath. By way of example, a reference electrode having a conductivity of 3000 mS/cm is 30× as conductive as a plating bath having a conductivity of 100 mS/cm. In various embodiments, the conductivity of the plating bath may be between about 3-120 mS/cm, though the embodiments are not so limited.

Figure 9B:
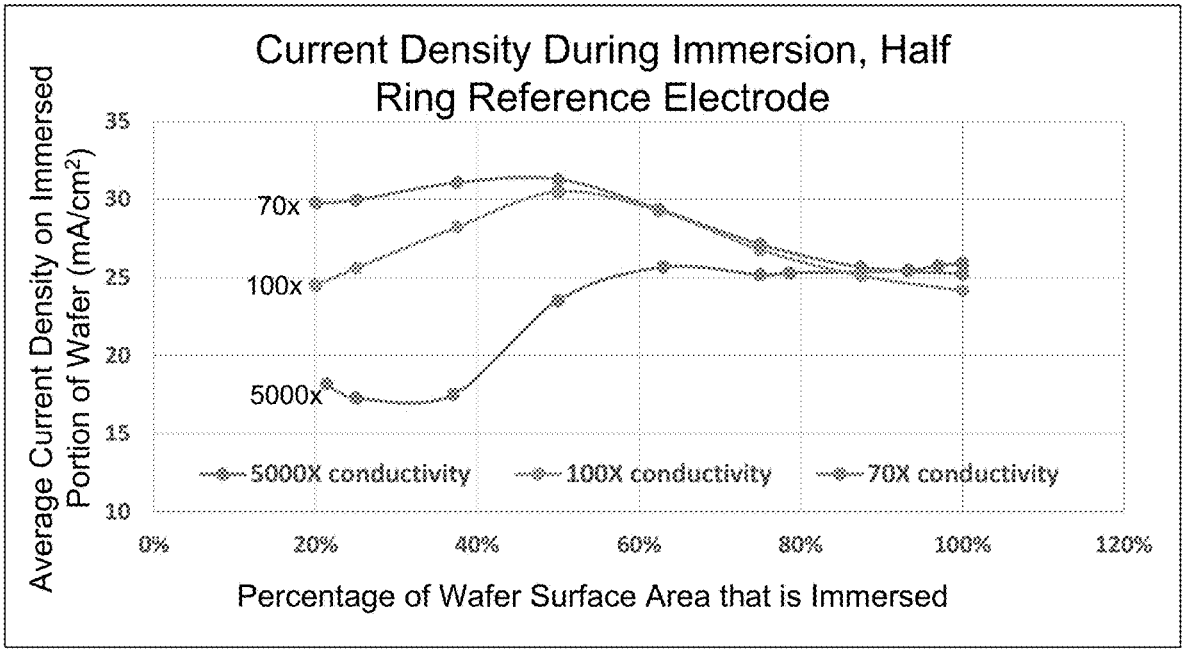
FIG. 9B is a graph showing modeling results related to the average current density applied to the immersed portion of a substrate over the course of immersion where a half-circle shaped reference electrode with different relative conductivities with respect to the electrolyte are used.

FIG. 9B presents modeling results showing information similar to that shown in FIG. 9A (current density during immersion), though the data in FIG. 9B relate to cases where the reference electrode is a half ring electrode. The data show that where the reference electrode is 5000× as conductive as the plating bath, the current density starts lower than desired. This result matches with that predicted in the case of the highly conductive (5000×) full ring reference electrode. Where the reference electrode is less conductive (e.g., 70× as conductive or 100× as conductive as the plating bath), the current density uniformity over the course of immersion is significantly improved.

FIG. 9C presents a table that lists different ranges for arc-shaped reference electrodes (the ranges corresponding to the angular extent of the reference electrode, a half ring electrode having a 180° arc, for example) along with possible ranges for the relative conductivity of the reference electrode compared to the conductivity of the plating bath, in certain cases. While the embodiments are not limited to the examples shown in FIG. 9C, the listed relative conductivities have been identified as achieving particularly uniform current density during immersion for each particular reference electrode shape in certain implementations.

The conductivity of a reference electrode can be tuned by controlling the type and relative amounts of material used to fabricate the reference electrode. For example, a reference electrode may include a core of an electrically insulating material (e.g., plastic or other insulator) that may be coated with an electrically conductive material (e.g., copper, though many other materials may also be used). The thickness/amount of conductive material applied to the insulating core affects the conductivity of the reference electrode. In certain other cases, the conductivity of a reference electrode is controlled by selecting an electrode made from a material that has an appropriate conductivity. The conductivity of a plating bath is a function of the composition of the plating bath (e.g., the concentration of metal ions and acid), and can be tuned as appropriate for a particular application.

Segmented Reference Electrode

Figure 10:
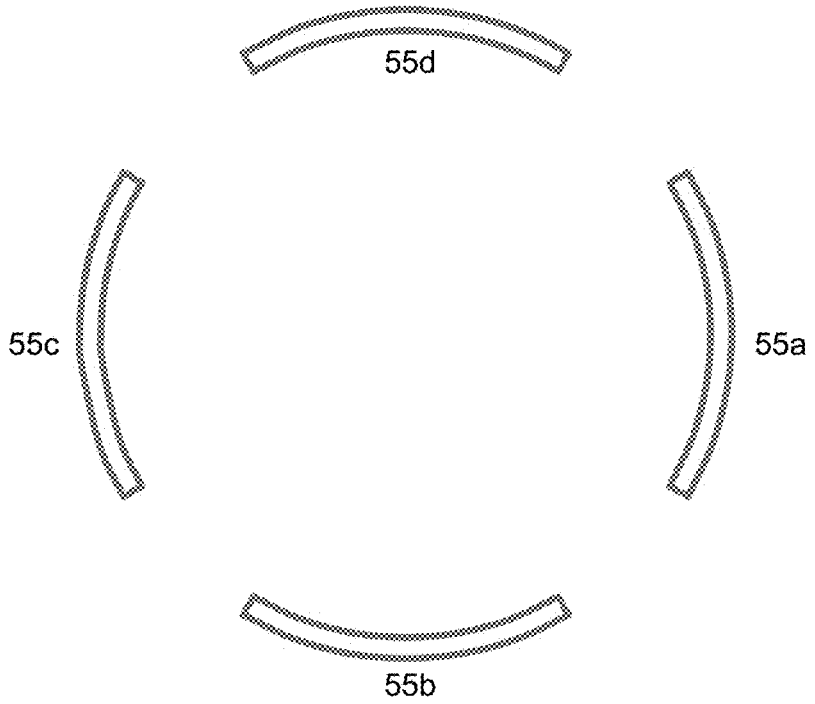
FIG. 10 is a simplified top-down view of a segmented reference electrode according to one embodiment.

In certain implementations, a segmented reference electrode may be used. FIG. 10 presents one example of a segmented reference electrode including 4 segments 55*a*-55*d*. In certain other embodiments, the reference electrode may include fewer segments or additional segments. For instance, the number of segments may be between about 2-8 in some cases, for example between about 4-6. In certain embodiments, the space between adjacent segments may be between about 2.5-12.5 cm, or between about 5-10 cm, which may represent between about 20-40% of the diameter of the substrate being processed. The segments may be activated/deactivated independently. In some embodiments, the segments are independently activated and/or deactivated during a substrate immersion process. The segments may also be independently turned activated and/or deactivated after substrate immersion is complete.

By activated/deactivated the segments independently, the current density distribution applied to immersed areas of the substrate can be controlled. In some cases, two or more of the individual segments may be activated and/or deactivated at substantially the same time. In these or other cases, two or more of the individual segments may be activated and/or deactivated sequentially. The segments may be activated and/or deactivated in the same direction as substrate rotation in some cases. For instance, with respect to FIG. 10 where the substrate rotates in a clockwise manner, segment 55*a* may be activated (and/or deactivated) first, followed by segment 55*b*, followed by segment 55*c*, followed by segment 55*d*. In another example, the segments are activated and/or deactivated in the direction opposite the direction in which the substrate rotates. For instance, with respect to FIG. 10 where the substrate rotates in a clockwise manner, segment 55*a* may be activated (and/or deactivated) first, followed by segment 55*d*, followed by segment 55*c*, followed by segment 55*b*. In yet another example, the segments may be activated and/or deactivated in both directions. With respect to FIG. 10, segment 55*a* may activated and/or deactivated first, followed by segments 55*b* and 55*d*, followed by segment 55*c*. In some embodiments, the first segment(s) that are activated or deactivated are those positioned proximate the substrate entry position. This is not always the case, however. In some other embodiments, the first segment(s) that are activated or deactivated are those positioned at an angular offset from the substrate entry position, for example at any of the positions as described above in the section related to the Location of the Reference Electrode.

As noted, the segments may be activated and/or deactivated during (and after) immersion. In various embodiments, all of the segments are activated when the leading edge of the substrate first enters electrolyte. In certain embodiments, some segments may be de-activated by the time the trailing edge of the substrate is immersed in electrolyte. Each of the segments may be controlled by a single controller and a single power supply or by individual controllers and/or power supplies.

Providing a multi-segment reference electrode is one method to control the conductivity of the reference electrode too. The number of segments, the relative positions of the segments, the space between adjacent segments, etc. can all affect the conductivity of the reference electrode. Further, activating/deactivating the individual segments of the reference electrode effectively changes the conductivity/resistivity at different portions of the electroplating cell, thereby allowing control over the average current density and current density distribution applied to the immersed portion of the substrate.

Dynamic Reference Electrode

In some embodiments, a reference electrode may be designed as a dynamic reference electrode. Dynamic reference electrodes can change one or more of their characteristics during an electroplating process. Example characteristics that may change include the location and shape of the reference electrode. Another characteristic that may change during plating where a segmented reference electrode is used is which segments of the reference electrode are activated at a given time (as discussed above with respect to the segmented reference electrode).

Both the position of the reference electrode and the shape of the reference electrode can significantly affect the current and current density applied to immersed portions of a substrate over the course of immersion, as discussed in the sections above. In some embodiments, it may be beneficial to change the location and/or shape of a reference electrode during plating to thereby take advantage of the different current/current densities achieved for the various reference electrode positions/shapes during different portions of the immersion process.

Figure 11:
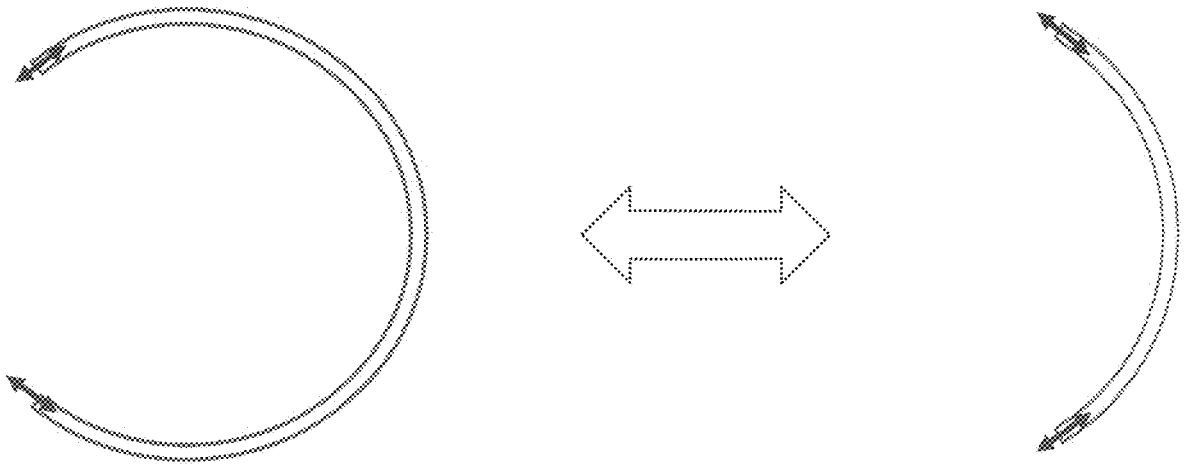
FIG. 11 is a simplified top-down view of a dynamic reference electrode having a changeable shape according to one embodiment.

FIG. 11 presents a top-down view of a reference electrode that has a dynamically changeable shape. Two different shapes are shown including an extended shape (left) and a retracted shape (right), though it should be understood that any shape between the two illustrated in FIG. 11 may be achieved. Shapes that are more extended and more retracted are also possible. In some cases the reference electrode may be designed such that the shape is continuously variable. The electrode may be made of segments that slide over one another, telescope into one another, etc.

Potential benefits of a reference electrode with a dynamically changeable shape can be better understood with reference to FIG. 7. In various cases, it may be beneficial to change the shape of the reference electrode during immersion to achieve the desired current density performance at different stages of immersion. In one example, a reference electrode may start as a quarter ring electrode and extend out to a half ring or full ring electrode over the course of immersion. This may allow the current density to be adequately high during the initial portion of immersion, while also preventing the current density from rising too much over the next portion (e.g., a middle portion) of the immersion process. In effect, the current density may start at the quarter ring line, but instead of increasing substantially over the first 30% of immersion, the current density can remain more uniform over time as the shape of the reference electrode changes and the current density is lowered closer to lines corresponding to the half ring or full ring cases. The timing/rate at which the reference electrode changes shape can be optimized for particular results, for example to achieve a uniform average current density applied to the immersed portion of a substrate over the course of immersion.

The ability to change the shape of a reference electrode may be beneficial because in various cases, a reference electrode shape that achieves a sufficiently high current density during the initial portion of immersion (e.g., during the first 5%) will also have a current density that significantly rises after immersion (e.g., during the first 20% or 30%). Examples may include the point reference electrode and/or the quarter ring reference electrode in some cases, with relevant current density traces shown in FIG. 7. By contrast, a reference electrode shape that achieves a relatively lower and/or later rise in current density often results in an initial current density that is too low. One example may include the full ring reference electrode, a relevant current density trace being shown in FIG. 7. By changing the shape of the reference electrode during immersion, it may be possible to both (a) achieve a sufficiently high current density when the substrate is first immersed, and (b) avoid a substantial rise in current density as immersion continues.

In certain embodiments, the reference electrode is designed as a retractable arc, as shown in FIG. 11. The retractable arc may change shape over the course of immersion, with a first position at the beginning of immersion when the substrate first enters electrolyte and a second position at the end of immersion when the substrate is completely immersed. The reference electrode may in some cases continue to change shape after the substrate is completely immersed, with the ultimate shape of the reference electrode being referred to as the final shape. In other cases, the reference electrode shape does not change after immersion is complete. And in certain embodiments, the reference electrode stops changing shape part-way through the immersion process.

The first and second shapes (as well as a final shape if the reference electrode continues to change shape after immersion) can each be any of the arc shapes mentioned herein. In some cases the first arc shape is smaller than the second arc shape. In this case the reference electrode gets larger over time, for instance going from the shape on the right hand side of FIG. 11 to the shape on the left hand side in FIG. 11. In other cases the first arc shape may be larger than the second arc shape. In this embodiment the reference electrode gets smaller over time. Particular examples for the first and/or second arc shapes include, for example, arcs that span between about 10-30°, or between about 30-50°, or between about 50-70°, or between about 70-90°, or between about 90-110°, or between about 110-130°, or between about 130-150°, or between about 150-170°, or between about 170-190°, or between about 190-210°, or between about 210-230°, or between about 230-250°, or between about 250-270°, or between about 270-290°, or between about 290-310°, or between about 310-330°, or between about 330-350°, or between about 350-380°. In other words, any or all of the first, second, and final shapes may be within any of these ranges.

In some embodiments, the first and second shapes differ by at least about 10°, for example at least about 20°, at least about 30°, at least about 50°, at least about 75°, or at least about 100°. Where the first shape is an arc that spans 100° and the second shape is an arc that spans 130°, the first and second shapes are understood to differ by 30°. In certain embodiments, the first and second shapes differ by a certain percentage. For instance, where a first arc shape is 100° and the second arc shape is 130°, the second arc shape is 30% larger than the first arc shape ((130−100)/100=30%). This calculation is based on the initial shape. Where the first arc shape is 130° and the second arc shape is 100°, the second arc shape is about 23% smaller than the first arc shape ((100−130)/130=23%). In some implementations, the second arc shape is at least about 5%, 10%, 20%, 30%, 40%, 50%, or 75% bigger or smaller than the first arc shape.

As mentioned above, another characteristic of the reference electrode that may change over the course of immersion is the position of the reference electrode. For similar reasons as discussed with respect to a changeable shape, it may be beneficial to change the location of the reference electrode during immersion. In this way, it may be possible to achieve a desired average current density and/or current density distribution applied to the substrate during particular portions of an immersion process, and to particular portions of the substrate. In some embodiments, a substrate may be provided with features etched non-uniformly over the face of the substrate. For instance, one portion of the substrate may have densely positioned features and another portion of the substrate may have fewer features. Similarly, one portion of the substrate may have differently sized/shaped features than another portion of the substrate. For these or other reasons, it may be beneficial to deliver a higher current density to one portion of the substrate compared to another portion of the substrate. In some such cases, providing a controlled non-uniform current density to different portions of the substrate may in some cases counteract other non-uniformities in the system (e.g., feature layout on a substrate) to result in desired (e.g., uniform) electroplating fill results. By changing the location and/or shape of the reference electrode, the current density applied to different portions of the substrate can be controlled as desired over the course of substrate immersion.

In some cases, a point reference electrode changes position during immersion. In other cases, an arc-shaped reference electrode changes position during immersion (optionally changing the shape of the arc as described above, as well). The position of the reference electrode may change in either angular direction with respect to the substrate entry position. In some cases the reference electrode moves in the same direction as the substrate rotates. In other cases the reference electrode moves in the opposite direction from substrate rotation. The vertical position of the reference electrode may also change during immersion in some embodiments. For instance, the reference electrode may become more or less immersed over the course of substrate immersion (with such depth changes optionally continuing after the substrate is completely immersed). Similarly, the radial distance between the center of the electroplating cell and the reference electrode may change over the course of immersion. For instance, the reference electrode may move horizontally closer to or farther away from the center of the electroplating cell during immersion (with such distance changes optionally continuing after the substrate is completely immersed).

The reference electrode may start at a first position when the leading edge of the substrate first enters electrolyte and move to a second position, the second position being the position of the electrode when the substrate is completely immersed in electrolyte. The reference electrode may continue to move after the substrate is completely immersed, with the ultimate location of the electrode being referred to as the final position of the reference electrode. In some cases the reference electrode reaches its second position before the substrate immersion is complete.

With respect to moving the reference electrode in an angular manner, in some cases the first and second positions of the reference electrode differ by at least about 5°, or at least about 10°, or at least about 20°, or at least about 30°, or at least about 50°, or at least about 75°. In these or other cases, the first and second positions of the reference electrode may vary about 180° or less, or about 150° or less, or 120° or less, or 90° or less, or 70° or less, or about 50° or less.

The reference electrode may be provided with appropriate hardware to achieve the dynamically changeable shape and/or dynamically changeable position. Such hardware may include, for example, a connection to a power supply, a connection to a controller, a motor/magnets/other mechanism or module for changing the shape of the reference electrode. In some cases the change in shape and/or location of the reference electrode may occur during a single electroplating process on a single wafer. In other cases the change in shape and/or location of the reference electrode may occur between electroplating processes on different substrates. A changeable reference electrode may enable optimization of various processes on a single electroplating apparatus, thereby increasing the flexibility of the apparatus and allowing the apparatus to be used for different applications while maintaining high quality plating results.

Apparatus

The methods described herein may be performed by any suitable apparatus. A suitable apparatus includes hardware for accomplishing the process operations and a system controller having instructions for controlling process operations in accordance with the present embodiments. For example, in some embodiments, the hardware may include one or more process stations included in a process tool.

Figure 12:
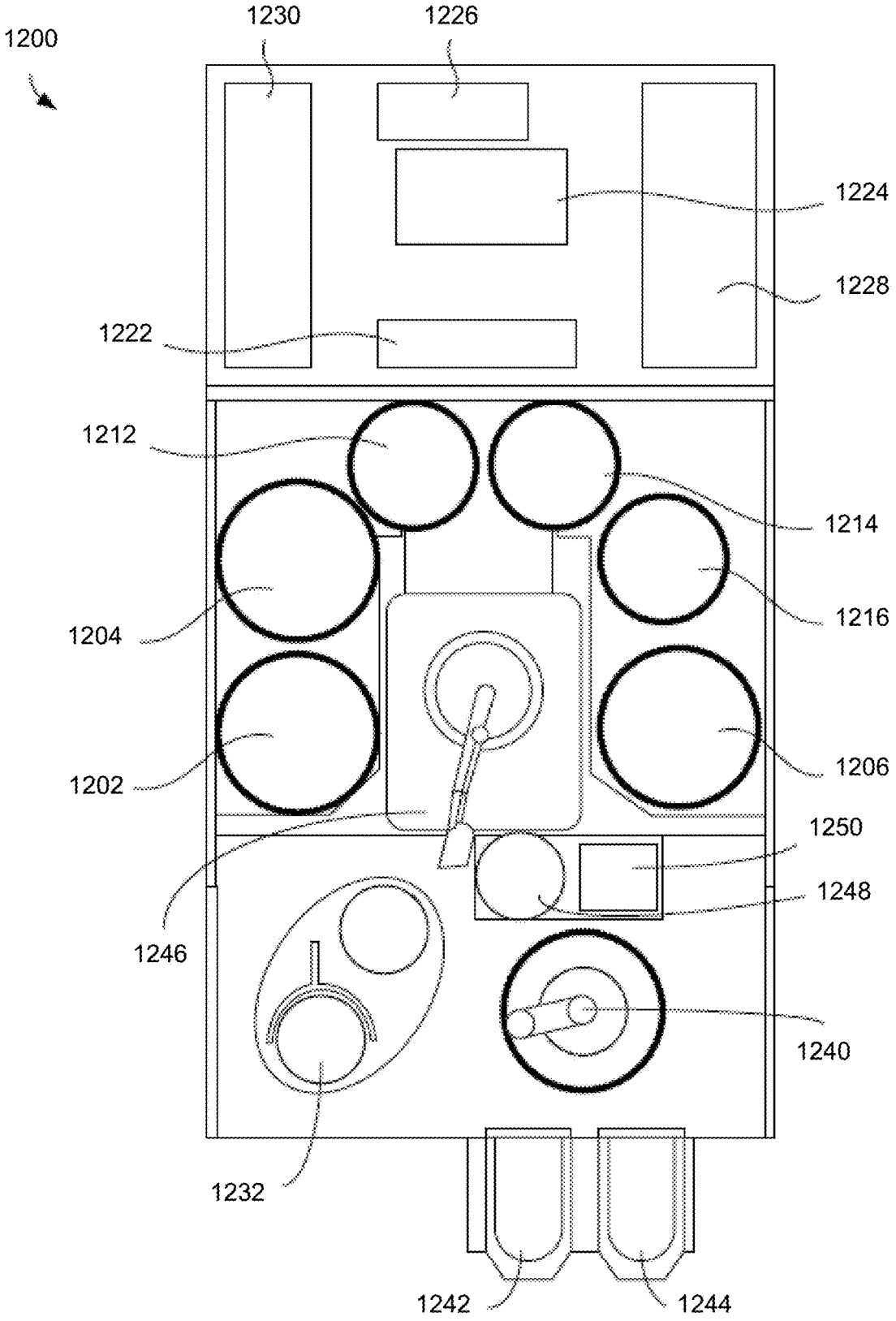
FIGS. 12 and 13 present simplified views of integrated multi-chamber electroplating apparatus according to certain embodiments.

FIG. 12 shows an example multi-tool apparatus that may be used to implement the embodiments herein. The electrodeposition apparatus 1200 can include three separate electroplating modules 1202, 1204, and 1206. Further, three separate modules 1212, 1214 and 1216 may be configured for various process operations. For example, in some embodiments, one or more of modules 1212, 1214, and 1216 may be a spin rinse drying (SRD) module. In these or other embodiments, one or more of the modules 1212, 1214, and 1216 may be post-electrofill modules (PEMs), each configured to perform a function, such as edge bevel removal, backside etching, and acid cleaning of substrates after they have been processed by one of the electroplating modules 1202, 1204, and 1206. Further, one or more of the modules 1212, 1214, and 1216 may be configured as a pre-treatment chamber. The pre-treatment chamber may be a remote plasma chamber or an anneal chamber as described herein. Alternatively, a pre-treatment chamber may be included at another portion of the apparatus, or in a different apparatus.

The electrodeposition apparatus 1200 includes a central electrodeposition chamber 1224. The central electrodeposition chamber 1224 is a chamber that holds the chemical solution used as the electroplating solution in the electroplating modules 1202, 1204, and 1206. The electrodeposition apparatus 1200 also includes a dosing system 1226 that may store and deliver additives for the electroplating solution. A chemical dilution module 1222 may store and mix chemicals to be used as an etchant. A filtration and pumping unit 1228 may filter the electroplating solution for the central electrodeposition chamber 1224 and pump it to the electroplating modules.

A system controller 1230 provides electronic and interface controls used to operate the electrodeposition apparatus 1200. The system controller 1230 is introduced above in the System Controller section, and is described further herein. The system controller 1230 (which may include one or more physical or logical controllers) controls some or all of the properties of the electroplating apparatus 1200. The system controller 1230 typically includes one or more memory devices and one or more processors. The processor may include a central processing unit (CPU) or computer, analog and/or digital input/output connections, stepper motor controller boards, and other like components. Instructions for implementing appropriate control operations as described herein may be executed on the processor. These instructions may be stored on the memory devices associated with the system controller 1230 or they may be provided over a network. In certain embodiments, the system controller 1230 executes system control software.

The system control software in the electrodeposition apparatus 1200 may include instructions for controlling the timing, mixture of electrolyte components (including the concentration of one or more electrolyte components), electrolyte gas concentrations, inlet pressure, plating cell pressure, plating cell temperature, substrate temperature, current and potential applied to the substrate and any other electrodes, substrate position, substrate rotation, and other parameters of a particular process performed by the electrodeposition apparatus 1200.

In some embodiments, there may be a user interface associated with the system controller 1230. The user interface may include a display screen, graphical software displays of the apparatus and/or process conditions, and user input devices such as pointing devices, keyboards, touch screens, microphones, etc.

In some embodiments, parameters adjusted by the system controller 1230 may relate to process conditions. Non-limiting examples include solution conditions (temperature, composition, and flow rate), substrate position (rotation rate, linear (vertical) speed, angle from horizontal) at various stages, etc. These parameters may be provided to the user in the form of a recipe, which may be entered utilizing the user interface.

Signals for monitoring the process may be provided by analog and/or digital input connections of the system controller 1230 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

In one embodiment of a multi-tool apparatus, the instructions can include inserting the substrate in a wafer holder, tilting the substrate, biasing the substrate during immersion, and electrodepositing metal on a substrate. The instructions may further include pre-treating the substrate, annealing the substrate after electroplating, and transferring the substrate as appropriate between relevant apparatus.

A hand-off tool 1240 may select a substrate from a substrate cassette such as the cassette 1242 or the cassette 1244. The cassettes 1242 or 1244 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 940 may hold the substrate using a vacuum attachment or some other attaching mechanism.

The hand-off tool 1240 may interface with a wafer handling station 1232, the cassettes 1242 or 1244, a transfer station 1250, or an aligner 1248. From the transfer station 1250, a hand-off tool 1246 may gain access to the substrate. The transfer station 1250 may be a slot or a position from and to which hand-off tools 1240 and 1246 may pass substrates without going through the aligner 1248. In some embodiments, however, to ensure that a substrate is properly aligned on the hand-off tool 1246 for precision delivery to an electroplating module, the hand-off tool 1246 may align the substrate with an aligner 1248. The hand-off tool 1246 may also deliver a substrate to one of the electroplating modules 1202, 1204, or 1206, or to one of the separate modules 1212, 1214 and 1216 configured for various process operations.

An apparatus configured to allow efficient cycling of substrates through sequential plating, rinsing, drying, and PEM process operations may be useful for implementations for use in a manufacturing environment. To accomplish this, the module 1212 can be configured as a spin rinse dryer and an edge bevel removal chamber. With such a module 1212, the substrate would only need to be transported between the electroplating module 1204 and the module 1212 for the copper plating and EBR operations. One or more internal portions of the apparatus 1200 may be under sub-atmospheric conditions. For instance, in some embodiments, the entire area enclosing the plating cells 1202, 1204 and 1206 and the PEMs 1212, 1214 and 1216 may be under vacuum. In other embodiments, an area enclosing only the plating cells is under vacuum. In further implementations, the individual plating cells may be under vacuum. While electrolyte flow loops are not shown in FIG. 12 or 13, it is understood that the flow loops described herein may be implemented as part of (or in conjunction with) a multi-tool apparatus.

Figure 13:
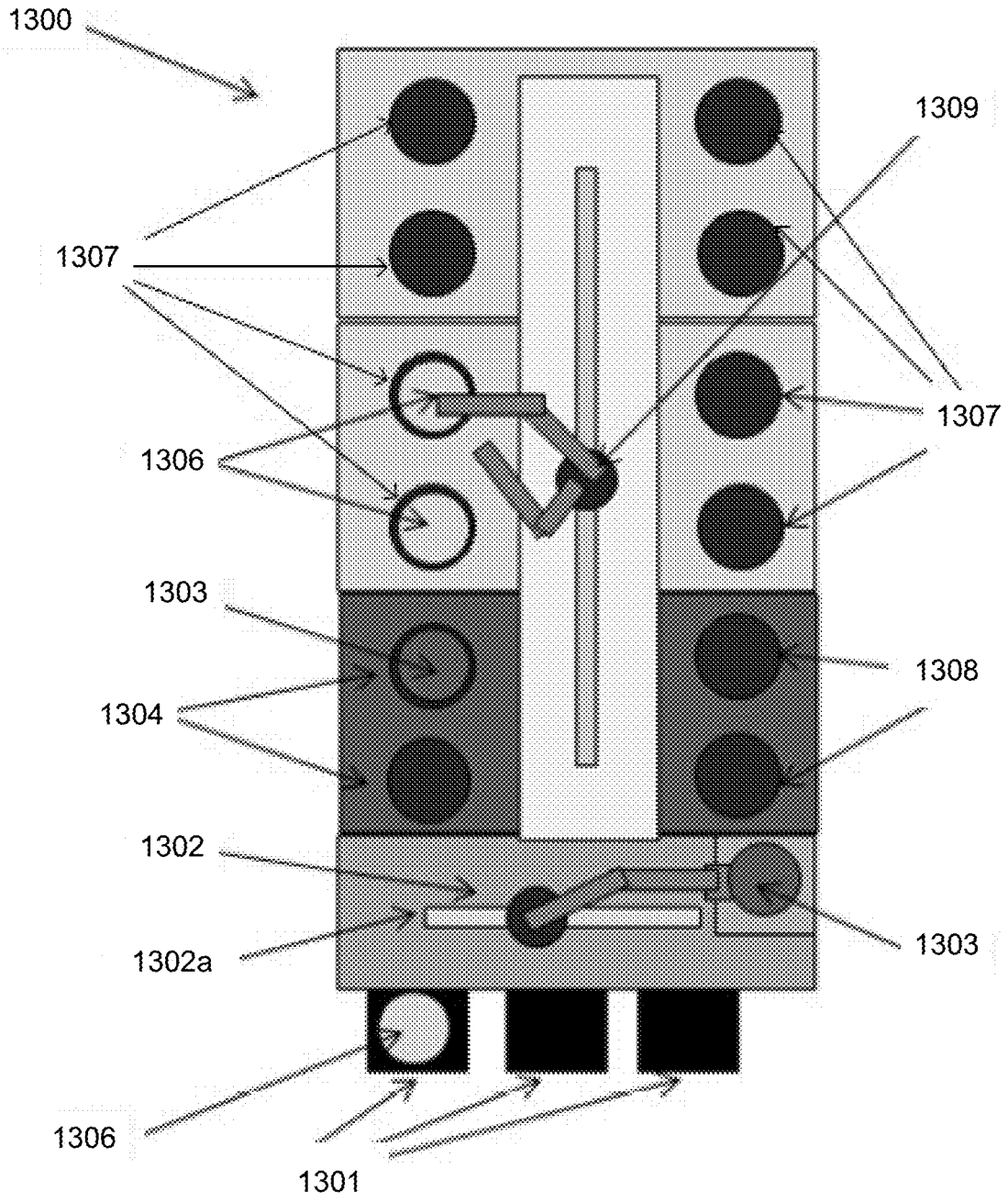

FIG. 13 shows an additional example of a multi-tool apparatus that may be used in implementing the embodiments herein. In this embodiment, the electrodeposition apparatus 1300 has a set of electroplating cells 1307, each containing an electroplating bath, in a paired or multiple "duet" configuration. In addition to electroplating per se, the electrodeposition apparatus 1300 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. The electrodeposition apparatus

1300 is shown schematically looking top down, and only a single level or "floor" is revealed in the figure, but it is to be readily understood by one having ordinary skill in the art that such an apparatus, e.g., the Sabre™ 3D tool of Lam Research Corporation of Fremont, Calif. can have two or more levels "stacked" on top of each other, each potentially having identical or different types of processing stations.

Referring once again to FIG. 13, the substrates 1306 that are to be electroplated are generally fed to the electrodeposition apparatus 1300 through a front end loading FOUP 1301 and, in this example, are brought from the FOUP to the main substrate processing area of the electrodeposition apparatus 1300 via a front-end robot 1302 that can retract and move a substrate 1306 driven by a spindle 1303 in multiple dimensions from one station to another of the accessible stations—two front-end accessible stations 1304 and also two front-end accessible stations 1308 are shown in this example. The front-end accessible stations 1304 and 1308 may include, for example, pre-treatment stations, and spin rinse drying (SRD) stations. These stations 1304 and 1308 may also be removal stations as described herein. Lateral movement from side-to-side of the front-end robot 1302 is accomplished utilizing robot track 1302*a*. Each of the substrates 1306 may be held by a cup/cone assembly (not shown) driven by a spindle 1303 connected to a motor (not shown), and the motor may be attached to a mounting bracket 1309. Also shown in this example are the four "duets" of electroplating cells 1307, for a total of eight electroplating cells 1307. The electroplating cells 1307 may be used for electroplating copper for the copper containing structure and electroplating solder material for the solder structure (among other possible materials). A system controller (not shown) may be coupled to the electrodeposition apparatus 1300 to control some or all of the properties of the electrodeposition apparatus 1300. The system controller may be programmed or otherwise configured to execute instructions according to processes described earlier herein.

System Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. A method of electroplating metal onto a substrate, the method comprising:

immersing the substrate in electrolyte in an electroplating chamber, wherein the substrate is immersed at an angle such that a leading edge of the substrate contacts the electrolyte before a trailing edge of the substrate, the leading edge of the substrate first contacting the electrolyte at a substrate entry position;

monitoring a potential difference between the substrate and a reference electrode, wherein the reference electrode is positioned radially outside of the periphery of the substrate and angularly offset from the substrate entry position; and electroplating metal onto the substrate.

2. The method of claim 1, wherein the angular offset is about 60°.

3. The method of claim 1, wherein the angular offset is about 180°.

4. The method of claim 1, wherein the angular offset is about 30°.

5. The method of claim 1, wherein the reference electrode is a point reference electrode and wherein the angular offset is between about 5-60°.

6. The method of claim 5, wherein the angular offset is between about 10-45°.

7. The method of claim 6, wherein the angular offset is between about 20-40°.

8. The method of claim 7, wherein the angular offset is between about 25-35°.

9. The method of claim 1, further comprising rotating the substrate while immersing the substrate in the electrolyte, wherein the reference electrode is angularly offset from the substrate entry position by up to 180° in the same direction as the substrate is being rotated, such that the leading edge of the substrate is moving closer to the reference electrode when the leading edge of the substrate first contacts the electrolyte.

10. The method of claim 1, further comprising rotating the substrate while immersing the substrate in the electrolyte, wherein the reference electrode is angularly offset from the substrate entry position by up to 180° in the opposite direction as the substrate is being rotated, such that the leading edge of the substrate is moving away from to the reference electrode when the leading edge of the substrate first contacts the electrolyte.

11. The method of claim 1, wherein the reference electrode is positioned within the electroplating chamber, in contact with the same electrolyte in which the substrate is immersed.

12. The method of claim 11, wherein the reference electrode is positioned such that a top surface of the reference electrode is immersed in the electrolyte and is not more than about 2 inches from an electrolyte-air interface.

13. The method of claim 1, wherein the reference electrode is positioned in a reference electrode chamber, wherein the reference electrode chamber comprises a membrane that separates (a) the electrolyte in which the substrate is immersed and (b) electrolyte in which the reference electrode is immersed.

* * * * *